US011260412B2

(12) United States Patent
Tomuta et al.

(10) Patent No.: US 11,260,412 B2
(45) Date of Patent: Mar. 1, 2022

(54) FLUID APPLICATION DEVICE

(71) Applicant: The Boeing Company, Chicago, IL (US)

(72) Inventors: Raul Tomuta, Long Beach, CA (US); Angelica Davancens, Reseda, CA (US); Richard Philip Topf, Orange, CA (US); Branko Sarh, Huntington Beach, CA (US)

(73) Assignee: The Boeing Company, Chicago, IL (US)

( * ) Notice: Subject to any disclaimer, the term of this patent is extended or adjusted under 35 U.S.C. 154(b) by 299 days.

(21) Appl. No.: 16/047,934

(22) Filed: Jul. 27, 2018

(65) Prior Publication Data

US 2018/0333732 A1 Nov. 22, 2018

Related U.S. Application Data

(62) Division of application No. 13/769,569, filed on Feb. 18, 2013, now Pat. No. 10,105,725.

(51) Int. Cl.

| | |
|---|---|
| ***B05D 1/26*** | (2006.01) |
| ***B05B 13/04*** | (2006.01) |
| ***B05C 1/02*** | (2006.01) |
| ***B05C 5/02*** | (2006.01) |
| *B05C 1/06* | (2006.01) |

(52) U.S. Cl.

CPC ..... *B05B 13/0431* (2013.01); *B05C 1/02* (2013.01); *B05C 5/0208* (2013.01); *B05C 5/0216* (2013.01); *B05C 1/06* (2013.01)

(58) Field of Classification Search

CPC ... B05D 1/26; B05D 1/28; B05D 7/22; B05D 7/222; B05D 7/225; B05D 7/227

See application file for complete search history.

(56) References Cited

U.S. PATENT DOCUMENTS

| | | | |
|---|---|---|---|
| 1,003,650 | A | 9/1911 | Redin |
| 1,909,146 | A | 5/1933 | Bohanan |
| 1,988,557 | A | 1/1935 | Jecker |
| 2,126,999 | A | 8/1938 | Mitchell |

(Continued)

FOREIGN PATENT DOCUMENTS

| | | | |
|---|---|---|---|
| CN | 1439999 | A | 9/2003 |
| CN | 101858456 | B | 12/2012 |

(Continued)

OTHER PUBLICATIONS

Korean Intellectual Property Office Notice of Office Action and English Translation, dated Feb. 17, 2020, regarding Application No. 10-2015-7021516, 14 pages.

(Continued)

*Primary Examiner* — Nathan H Empie

(74) *Attorney, Agent, or Firm* — Yee & Associates, P.C.

(57) ABSTRACT

A method and apparatus for applying a viscous fluid onto a surface. An applicator associated with an extension member may be positioned over the surface using a robotic operator. The extension member may be configured to maintain a selected distance between the applicator and a fluid source for the viscous fluid. The viscous fluid may be dispensed from the fluid source to the applicator. The viscous fluid may be applied onto the surface using the applicator.

23 Claims, 15 Drawing Sheets

(56) References Cited

U.S. PATENT DOCUMENTS

| | | | | |
|---|---|---|---|---|
| 2,227,792 | A | 1/1941 | Norton, Jr. | |
| 2,608,705 | A | 9/1952 | Duff | |
| 2,609,974 | A | 9/1952 | Brous | |
| 2,824,443 | A | 2/1958 | Ames | |
| 2,978,722 | A | 4/1961 | Kusakabe | |
| 3,076,777 | A * | 2/1963 | Zeolla | C09K 3/10 524/525 |
| 3,078,823 | A * | 2/1963 | Cummings | B05C 7/08 118/306 |
| 3,378,331 | A | 4/1968 | Beasley | |
| 3,661,679 | A | 5/1972 | Law | |
| 3,746,253 | A | 7/1973 | Walberg | |
| 3,865,525 | A | 2/1975 | Dunn | |
| 3,888,421 | A | 6/1975 | Chow | |
| 3,963,180 | A | 6/1976 | Wagner | |
| 4,027,349 | A * | 6/1977 | Clavin | B08B 9/049 15/104.12 |
| 4,239,157 | A | 12/1980 | Fasth | |
| 4,570,834 | A | 2/1986 | Ward | |
| 4,635,827 | A | 1/1987 | Roedig | |
| 4,698,005 | A | 10/1987 | Kikuchi et al. | |
| 4,925,061 | A | 5/1990 | Jeromson, Jr. et al. | |
| 4,932,094 | A | 6/1990 | McCowin | |
| 4,944,459 | A | 7/1990 | Watanabe et al. | |
| 4,948,016 | A | 8/1990 | Summons et al. | |
| 4,989,792 | A | 2/1991 | Claassen | |
| 5,017,113 | A | 5/1991 | Heaton et al. | |
| 5,060,869 | A | 10/1991 | Bekius | |
| 5,186,563 | A | 2/1993 | Gebhard et al. | |
| 5,271,521 | A | 12/1993 | Noss et al. | |
| 5,271,537 | A | 12/1993 | Johnson | |
| 5,319,568 | A | 6/1994 | Bezaire | |
| 5,346,380 | A | 9/1994 | Ables | |
| 5,462,199 | A | 10/1995 | Lenhardt | |
| 5,480,487 | A | 1/1996 | Figini et al. | |
| 5,571,538 | A | 11/1996 | Cloud | |
| 5,615,804 | A | 4/1997 | Brown | |
| 5,803,367 | A | 9/1998 | Heard et al. | |
| 5,906,296 | A | 5/1999 | Martindale et al. | |
| 5,920,974 | A | 7/1999 | Bullen | |
| 5,976,631 | A | 11/1999 | Ramachandran | |
| 5,992,686 | A | 11/1999 | Cline et al. | |
| 5,995,909 | A | 11/1999 | Bretmersky et al. | |
| 6,001,181 | A | 12/1999 | Bullen | |
| 6,082,587 | A | 7/2000 | Martindale et al. | |
| 6,213,354 | B1 | 4/2001 | Kay | |
| 6,471,774 | B1 | 10/2002 | Krueger | |
| 6,536,969 | B2 | 3/2003 | Nishitani | |
| 6,698,617 | B1 | 3/2004 | Szymanski | |
| 6,739,483 | B2 | 5/2004 | White et al. | |
| 6,935,541 | B1 | 8/2005 | Campbell et al. | |
| 6,942,736 | B2 | 9/2005 | Chinander et al. | |
| 6,986,472 | B2 | 1/2006 | Gordon | |
| 7,032,839 | B2 | 4/2006 | Blette et al. | |
| 7,101,107 | B1 | 9/2006 | Byun | |
| 7,172,096 | B2 | 2/2007 | O'Dougherty | |
| 7,275,663 | B2 | 10/2007 | Campbell et al. | |
| 7,578,416 | B2 | 8/2009 | Underwood | |
| 7,592,033 | B2 | 9/2009 | Buckley et al. | |
| 7,815,132 | B2 | 10/2010 | Baltz | |
| 7,922,107 | B2 | 4/2011 | Fox | |
| 8,146,196 | B2 * | 4/2012 | Seo | B08B 9/0492 15/104.16 |
| 8,181,822 | B2 | 5/2012 | Doelman et al. | |
| 8,453,876 | B2 | 6/2013 | Miller | |
| 8,534,499 | B2 | 9/2013 | Williams et al. | |
| 8,651,046 | B1 | 2/2014 | Davancens et al. | |
| 9,016,530 | B2 | 4/2015 | Topf et al. | |
| 9,095,872 | B2 | 8/2015 | Topf et al. | |
| 2001/0038039 | A1 | 11/2001 | Schultz et al. | |
| 2003/0156401 | A1 | 8/2003 | Komine et al. | |
| 2004/0129208 | A1 | 7/2004 | Nolte et al. | |
| 2004/0192524 | A1 | 9/2004 | Nolte et al. | |
| 2005/0145724 | A1 | 7/2005 | Blette et al. | |
| 2006/0081175 | A1 | 4/2006 | Nagase | |
| 2008/0083371 | A1 | 4/2008 | Clifford et al. | |
| 2009/0291196 | A1 | 11/2009 | Morris et al. | |
| 2010/0260531 | A1 | 10/2010 | Rademacher | |
| 2010/0279045 | A1 * | 11/2010 | Nakajima | B32B 27/20 428/36.9 |
| 2011/0297175 | A1 | 12/2011 | Pires et al. | |
| 2012/0273115 | A1 | 11/2012 | Suzuki et al. | |
| 2014/0234011 | A1 | 8/2014 | Tomuta et al. | |
| 2014/0326760 | A1 | 11/2014 | Topf et al. | |
| 2015/0028051 | A1 | 1/2015 | Topf et al. | |
| 2015/0044376 | A1 | 2/2015 | Topf et al. | |
| 2015/0053787 | A1 | 2/2015 | Tomuta et al. | |
| 2015/0064357 | A1 | 3/2015 | Tomuta et al. | |
| 2016/0175883 | A1 | 6/2016 | Tomuta et al. | |

FOREIGN PATENT DOCUMENTS

| | | | |
|---|---|---|---|
| CN | 104136130 | A | 11/2014 |
| DE | 102004027789 | A1 | 2/2005 |
| DE | 202005005619 | U1 | 2/2006 |
| DE | 102004042211 | A1 | 3/2006 |
| DE | 102007038791 | A1 | 2/2009 |
| DE | 102008010169 | A1 | 9/2009 |
| DE | 202007019244 | U1 | 8/2011 |
| DE | 102010030375 | A1 | 12/2011 |
| EP | 0181483 | A1 | 5/1986 |
| EP | 1245348 | A1 | 10/2002 |
| EP | 1425107 | B1 | 5/2006 |
| EP | 2277631 | A1 | 1/2011 |
| EP | WO2014126675 | A1 | 8/2014 |
| EP | 2839885 | A1 | 2/2015 |
| EP | 2956245 | A1 | 12/2015 |
| FR | 2508350 | A1 | 12/1982 |
| GB | 2282554 | A | 4/1995 |
| GB | 2481299 | A | 12/2011 |
| JP | S4929616 | A | 3/1974 |
| JP | S5016734 | A | 2/1975 |
| JP | S52142747 | A | 11/1977 |
| JP | S5827672 | A | 3/1983 |
| JP | S5924172 | U | 2/1984 |
| JP | S61187269 | U | 11/1986 |
| JP | S625856 | U | 1/1987 |
| JP | S62148379 | U | 9/1987 |
| JP | H0395697 | U | 9/1991 |
| JP | H04038459 | A | 2/1992 |
| JP | H04083549 | A | 3/1992 |
| JP | H05154428 | A | 6/1993 |
| JP | H09314305 | A | 12/1997 |
| JP | H11262717 | A | 9/1999 |
| JP | 2002059049 | A | 2/2002 |
| JP | 2002192345 | A | 7/2002 |
| JP | 2002280798 | A | 9/2002 |
| JP | 2005138260 | A | 6/2005 |
| JP | 20105518 | A | 1/2010 |
| JP | 2010034571 | A | 2/2010 |
| JP | 2015047602 | A | 3/2015 |
| WO | WO0067915 | A1 | 11/2000 |
| WO | WO2004073883 | A | 9/2004 |
| WO | WO2005012845 | A2 | 2/2005 |
| WO | WO2010093494 | A1 | 8/2010 |
| WO | WO2011108358 | A2 | 9/2011 |
| WO | WO2013112178 | A1 | 8/2013 |

OTHER PUBLICATIONS

Final Office Action, dated Oct. 15, 2018, regarding U.S. Appl. No. 13/973,528, 34 pages.

Office Action, dated Feb. 27, 2019, regarding U.S. Appl. No. 13/973,528, 31 pages.

Notice of Allowance, dated Aug. 21, 2019, regarding U.S. Appl. No. 13/973,528, 27 pages.

State Intellectual Property Office of PRC, Notification of Fourth Office Action, and English translation, dated Jul. 25, 2018, regarding Application No. 201480008306X, 15 pages.

State Intellectual Property Office of PRC Notification of Second Office Action with English Translation, dated Sep. 26, 2018, regarding Application No. 2014104087216, 18 pages.

(56) References Cited

OTHER PUBLICATIONS

European Patent Office Communication, dated Nov. 16, 2018, regarding Application No. 14703214.8, 4 pages.
Notice of Allowance dated May 23, 2018, regarding U.S. Appl. No. 15/057,090, 14 pages.
Canadian Intellectual Property Office, Examination Search Report, dated Jul. 31, 2018, regarding Application No. 2898323, 19 pages.
Office Action, dated Apr. 16, 2018, regarding U.S. Appl. No. 13/973,528, 42 pages.
Notice of Allowance dated Apr. 18, 2018, regarding U.S. Appl. No. 13/769,569, 39 pages.
International Search Report and Written Opinion, dated Apr. 4, 2014, regarding Application No. PCT/US2014/011879, 9 pages.
International Search Report and Written Opinion, dated Jun. 4, 2014, regarding Application No. PCT/US2014/033738, 9 pages.
International Search Report and Written Opinion, dated Oct. 7, 2014, regarding Application No. PCT/US2014/040989, 10 pages.
Extended European Search Report, dated Oct. 15, 2014, regarding Application No. 14175644.5, 6 pages.
International Search Report and Written Opinion, dated Oct. 15, 2014, regarding Application No. PCT/US2014/045018, 9 pages.
Extended European Search Report, dated Jan. 8, 2015, regarding Application No. EP14180160.5, 6 pages.
Canadian Intellectual Property Office Examination Search Report, dated Jun. 10, 2015, regarding Application No. 2,858,185, 5 pages.
Canadian Intellectual Property Office Examination Search Report, dated Aug. 5, 2015, regarding Application No. 2,855,480, 4 pages.
Canadian Intellectual Property Office Examination Search Report, dated Apr. 13, 2016, regarding Application No. 2,858,185, 4 pages.
European Patent Office Communication, dated Nov. 30, 2016, regarding Application No. EP14703214.8, 6 pages.
State Intellectual Property Office of PRC Notification of First Office Action and English Translation, dated Nov. 28, 2016, regarding Application No. 201480008306X, 42 pages.
Canadian Intellectual Property Office Examination Report, dated Dec. 21, 2016, regarding Application No. 2,898,323, 3 pages.
European Patent Office Communication, dated Mar. 22, 2017, regarding USPTO Application No. EP14180160.5, 4 pages.
Canadian Intellectual Property Office Examination Report, dated Apr. 21, 2017, regarding Application No. 2,855,480, 4 pages.
State Intellectual Property Office of PRC Notification of First Office Action and English Translation, dated Apr. 24, 2017, regarding Application No. 201480045021.3, 19 pages.
Canadian Intellectual Property Office Office Action, dated Oct. 17, 2017, regarding Application No. 2,898,323, 15 pages.
State Intellectual Property Office of the PRC Notification of Second Office Action, dated Jul. 24, 2017, regarding Application No. 201480008306X, 49 pages.
State Intellectual Property Office of the PRC Notification of First Office Action, dated Dec. 1, 2017, regarding Application No. 2014104087216, 26 pages.
State Intellectual Property Office of the PR First Notification of Office Action, dated Jan. 2, 2018, regarding Application No. 201410443281.8, 9 pages.
State Intellectual Property Office of the PRC Notification of Third Office Action, dated Jan. 5, 2018, regarding Application No. 201480008306X, 50 pages.
Canadian Intellectual Property Office Examination Report, dated Feb. 12, 2018, regarding Application No. 2,855,480, 14 pages.
Japanese Patent Office Notice of Reasons for Rejection, dated Feb. 6, 2018, regarding Application No. 2015-558012, 24 pages.
Korean Intellectual Property Office Notice of Office Action, dated Feb. 14, 2018, regarding Application No. 10-2014-0089520, 12 pages.
Japanese Patent Office Notice of Reasons for Rejection and English translation, dated May 15, 2018, regarding Application No. 2014-167395, 10 pages.
"Compliance Nozzle," 1208-178-000 part specifications, Sealant Equipment and Engineering, Inc., 2 pages, accessed Apr. 9, 2013, http://sealantequipment.com/pdf/DispenseValves/1208-178%20Compliance%20Nozzle.pdf.
"Dispense Valves for Adhesives, Sealants, Lubricants, Epoxy, Polyurethane, Silicone & More," Kiss, No-Drip, Snuf-Bak, Tip-Seal,Manual, Metering, and High Flow valve part specifications, Sealant Equipment and Engineering, Inc., 12 pages, accessed Apr. 9, 2013, http://www.sealantequipment.com/dispensevalves-1part.htm.
"No-Drip Air Operated Fluid Dispense Valve," 2100-108 Series part specifications, Sealant Equipment and Engineering, Inc., 2 pages, accessed Apr. 9, 2013, http://www.sealantequipment.com/pdf/DispenseValves/2100-108%20No-Drip%20Valves.pdf.
"PPG Semco® Fillet Nozzles," PPG Aerospace, [online], [retrieved on Aug. 21, 2013] Retrieved online from<http://www.ppg.com/coatings/aerospace/semcoappsys/ semcosystems/semcopkgproducts/nozzlessmoothingtools/Pages/filletNozzles.aspx>, 2 pages.
"PPG Semco® Specialty Application Nozzles, Technical Data," PPG Industries Semco Packaging & Application Systems, [online] [retrieved on Aug. 21, 2013] Retrieved online from <http://www.ppg.com/coating/aerospace/semcoplg/semco_specialtLapplication_nozzels.pdf> 2 pages.
Office Action, dated Oct. 1, 2014, regarding U.S. Appl. No. 13/886,535, 17 pages.
Notice of Allowance, dated Dec. 19, 2014, regarding U.S. Appl. No. 13/886,535, 13 pages.
Office Action, dated Aug. 25, 2015, regarding U.S. Appl. No. 13/769,569, 44 pages.
Final Office Action, dated Feb. 8, 2016, regarding U.S. Appl. No. 13/769,569, 18 pages.
Office Action, dated Jun. 17, 2016, regarding U.S. Appl. No. 13/769,569, 13 pages.
Final Office Action, dated Dec. 30, 2016, regarding U.S. Appl. No. 13/769,569, 19 pages.
Office Action, dated Sep. 21, 2017, regarding U.S. Appl. No. 13/769,569, 21 pages.
Office Action, dated Nov. 19, 2015, regarding U.S. Appl. No. 13/963,218, 54 pages.
Final Office Action, dated Jun. 3, 2016 regarding U.S. Appl. No. 13/963,218, 17 pages.
Office Action, dated Oct. 7, 2016 regarding U.S. Appl. No. 13/963,218, 14 pages.
Notice of Allowance, dated Apr. 19, 2017, regarding U.S. Appl. No. 13/963,218, 20 pages.
Office Action, dated Nov. 28, 2014, regarding U.S. Appl. No. 13/951,817, 17 pages.
Notice of Allowance, dated Mar. 27, 2015, regarding U.S. Appl. No. 13/951,817, 12 pages.
Office Action, dated Sep. 22, 2016, regarding U.S. Appl. No. 13/973,528, 71 pages.
Final Office Action, dated Dec. 23, 2016, regarding U.S. Appl. No. 13/973,528, 22 pages.
Office Action, dated May 19, 2017, regarding U.S. Appl. No. 13/973,528, 23 pages.
Final Office Action, dated Oct. 3, 2017, regarding U.S. Appl. No. 13/973,528, 30 pages.
Office Action, dated May 11, 2015, regarding U.S. Appl. No. 14/016,846, 36 pages.
Final Office Action, dated Sep. 1, 2015, regarding U.S. Appl. No. 14/016,846, 10 pages.
Office Action, dated Sep. 22, 2017, regarding U.S. Appl. No. 15/057,090, 38 pages.
Final Office Action, dated Jan. 19, 2018, regarding U.S. Appl. No. 15/057,090, 24 pages.

* cited by examiner

FLUID APPLICATION DEVICE

CROSS-REFERENCE TO RELATED APPLICATION(S)

This application is a divisional of and claims the benefit of priority to U.S. patent application Ser. No. 13/769,569, filed Feb. 18, 2013, now U.S. Pat. No. 10,105,725, issued Oct. 23, 2018, the entire contents of which are incorporated herein by reference.

BACKGROUND INFORMATION

1. Field

The present disclosure relates generally to applying fluid onto a surface and, in particular, to applying fluid onto a surface using an applicator. Still more particularly, the present disclosure relates to a method and apparatus for dispensing a fluid from a fluid source to the applicator while applying the fluid onto a surface using the applicator.

2. Background

In some cases, during the manufacturing process, a fluid may need to be applied over a surface. The fluid may be, for example, without limitation, a sealant, a paste, a type of paint, an adhesive, or some other type of fluid. Oftentimes, brushes may be used to apply these fluids over a surface.

As one illustrative example, a brush may be dipped into a container holding a fluid, such as, for example, without limitation, a sealant. The container may be, for example, without limitation, a cup, a can, a tank, or some other type of container. Dipping the brush into the sealant in the container may allow some of the sealant to be retained by the bristles of the brush. After the brush is dipped into the sealant within the container, the brush may be used to manually apply the sealant onto a surface. In other words, the brush may be used to brush the sealant onto the surface.

As the sealant is applied onto the surface, the amount of sealant retained by the brush may decrease. Consequently, the brush may need to be re-dipped into the sealant in the container. When the area of the surface over which the sealant is to be applied is large, the process of re-dipping the brush between applications of the sealant onto the surface may need to be performed multiple times. This type of process may be more time-consuming than desired. Further, with this type of process, the amount of sealant used may exceed the actual amount of sealant that was needed. Therefore, it would be desirable to have a method and apparatus that take into account at least some of the issues discussed above, as well as possibly other issues.

SUMMARY

In one illustrative embodiment, an apparatus may comprise a platform, a fluid source associated with the platform, an extension member associated with the platform, and an applicator associated with the extension member. The fluid source may be configured to dispense a fluid. The extension member may be configured to extend from the platform. The applicator may be configured to receive the fluid dispensed by the fluid source. The applicator may be configured for use in applying the fluid onto a surface.

In another illustrative embodiment, an end effector may comprise an extension member, a platform associated with the extension member, a cartridge associated with the platform, an applicator associated with the extension member such that a selected distance may be maintained between the applicator and the cartridge, and an attachment unit. The cartridge may be configured to dispense a sealant. The applicator may be configured to receive the sealant dispensed by the cartridge. The applicator may be further configured for use in applying the sealant onto a surface. The attachment unit may be configured to attach the end effector to a robotic operator. The robotic operator may be configured to move at least one of the platform and the extension member to position the applicator over the surface.

In yet another illustrative embodiment, a fluid application device may comprise a platform, a cartridge associated with the platform, an extension member associated with the platform, a brush associated with the extension member, a fluid control system, an applicator movement system, an applicator coupling unit, and an attachment unit. The cartridge may be configured to dispense a sealant. The extension member may be configured to extend from the platform. The brush may be configured to receive the sealant dispensed by the cartridge. The brush may be configured for use in applying the sealant onto a surface. The fluid control system may be configured to control at least one of an amount of the sealant and a rate of the sealant dispensed to the brush. The fluid control system may comprise at least one of a hose, a valve system, and a nozzle. The applicator movement system may be configured to move the brush. The applicator movement system may comprise at least one of a first movement system and a second movement system. The first movement system may be configured to rotate the brush about a brush axis through the brush independently of the extension member. The first movement system may comprise at least one of a number of motors, a number of shafts, a number of belt systems, and a number of gears. The second movement system may be configured to rotate the extension member about an axis through the extension member. Rotation of the extension member may cause rotation of the brush about the axis. The second movement system may comprise at least one of a number of motors, a number of shafts, a number of belt systems, and a number of gears. The applicator coupling unit may be configured to couple the brush to the extension member. The attachment unit may be configured for association with the platform. The attachment unit may be configured for use in attaching the fluid application device to a robotic arm as an end effector.

In still yet another illustrative embodiment, a method for applying a viscous fluid onto a surface may be provided. An applicator associated with an extension member may be positioned over the surface using a robotic operator. The extension member may be configured to maintain a selected distance between the applicator and a fluid source for the viscous fluid. The viscous fluid may be dispensed from the fluid source to the applicator. The viscous fluid may be applied onto the surface using the applicator.

In yet another illustrative embodiment, a method for applying a sealant onto a surface may be present. A platform may be positioned using a robotic arm to position an extension member associated with the platform over the surface. The platform may be attached to the robotic arm by an attachment unit. The sealant may be dispensed from a cartridge associated with the platform to an applicator associated with the extension member. At least one of an amount of the sealant and a rate of the sealant dispensed from the cartridge to the applicator may be controlled using a fluid control system. The applicator may be rotated about an applicator axis through the applicator independently of the extension member using an applicator movement system. The extension member may be rotated about an axis through the extension member using the applicator movement system. Rotation of the extension member may cause rotation of the applicator about the axis. The sealant may be applied onto the surface using the applicator to seal a number of interfaces on the surface.

In still yet another illustrative embodiment, a method for applying a sealant onto a plurality of fasteners installed in a structure may be provided. An applicator associated with an extension member in a fluid application device may be moved to an initial position over a fastener in the plurality of fasteners using a robotic arm. The applicator may be rotated using an applicator movement system. A controlled amount of the sealant may be dispensed from a cartridge held by a platform associated with the extension member to the applicator at a controlled rate while the applicator is rotating. The sealant may be applied onto the fastener using the applicator according to a predefined application routine.

The features and functions can be achieved independently in various embodiments of the present disclosure or may be combined in yet other embodiments in which further details can be seen with reference to the following description and drawings.

BRIEF DESCRIPTION OF THE DRAWINGS

The novel features believed characteristic of the illustrative embodiments are set forth in the appended claims. The illustrative embodiments, however, as well as a preferred mode of use, further objectives and features thereof, will best be understood by reference to the following detailed description of an illustrative embodiment of the present disclosure when read in conjunction with the accompanying drawings, wherein:

DETAILED DESCRIPTION

Figure 1:
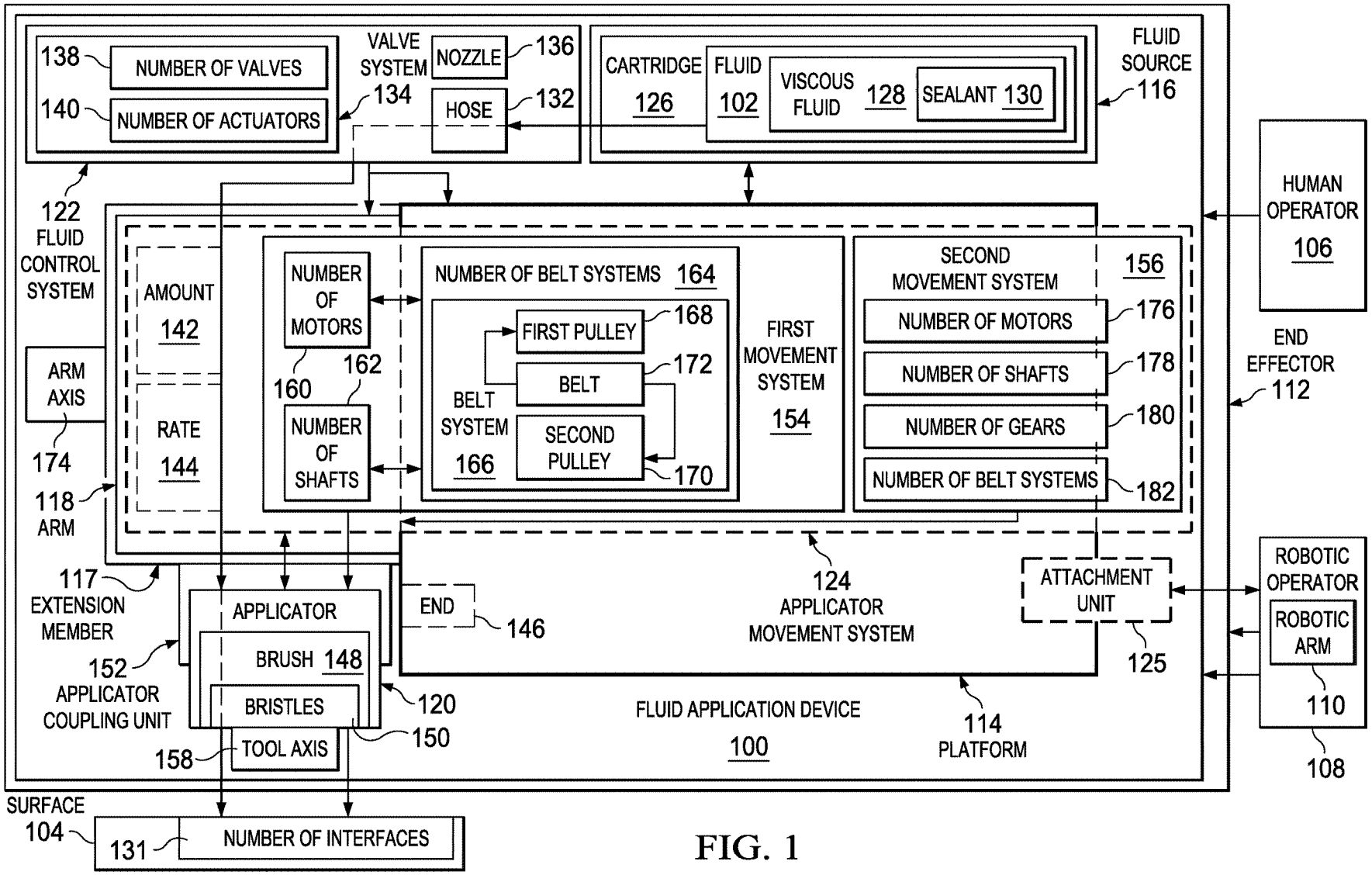
FIG. 1 is an illustration of a fluid application device in the form of a block diagram in accordance with an illustrative embodiment.

Referring now to the figures and, in particular, with reference to FIG. 1, an illustration of a fluid application device is depicted in the form of a block diagram in accordance with an illustrative embodiment. In this illustrative example, fluid application device 100 may be used to apply fluid 102 onto surface 104.

Fluid application device 100 may be operated by human operator 106 or robotic operator 108. For example, robotic operator 108 may be configured to operate fluid application device 100 and move fluid application device 100. In particular, robotic operator 108 may be used to position fluid application device 100 relative to surface 104 and/or move fluid application device 100 over surface 104.

In one illustrative example, robotic operator 108 comprises robotic arm 110. In this example, fluid application device 100 may take the form of end effector 112 configured for attachment to robotic arm 110.

As depicted, fluid application device 100 may include platform 114, fluid source 116, extension member 117, applicator 120, fluid control system 122, applicator movement system 124, and attachment unit 125. Attachment unit 125 may be configured to attach end effector 112 to robotic arm 110.

Platform 114 may be comprised of one or more structures configured to hold and support the various components of fluid application device 100. Depending on the implementation, one or more of fluid source 116, extension member 117, fluid control system 122, applicator movement system 124, and attachment unit 125 may be associated with platform 114. In some illustrative examples, attachment unit 125 may be associated with extension member 117.

When one component is "associated" with another component, as used herein, this association is a physical association in the depicted examples. For example, a first component, such as fluid source 116, may be considered to be associated with a second component, such as platform 114, by being secured to the second component, bonded to the second component, mounted to the second component, welded to the second component, fastened to the second component, and/or connected to the second component in some other suitable manner. In some cases, the first component may be considered associated with the second component by being connected to the second component by a third component. The first component also may be considered to be associated with the second component by being formed as part of and/or as an extension of the second component.

Fluid source 116 is configured to hold, or store, fluid 102. In this illustrative example, fluid source 116 may take the form of cartridge 126. However, in other illustrative examples, fluid source 116 may take some other form such as, for example, without limitation, a container, a tank, a reservoir, a casing, or some other type of storage structure.

In this illustrative example, fluid 102 held by cartridge 126 may be viscous fluid 128. As used herein, a "viscous" fluid may be a fluid that resists shear flow and strain linearly with time when a stress is applied. Viscous fluids may be considered as having a thick consistency. Viscous fluid 128 may have a viscosity between about 50 poise and about 12,500 poise in some illustrative examples. Of course, in other illustrative examples, viscous fluid 128 may have a viscosity less than about 50 poise or greater than about 12,500 poise.

In one illustrative example, viscous fluid 128 takes the form of sealant 130. Of course, in other illustrative examples, viscous fluid 128 may take the form of an adhesive. When viscous fluid 128 takes the form of sealant 130, fluid application device 100 may be referred to as a "sealant application device."

Sealant 130 may be applied onto surface 104 to, for example, without limitation, seal number of interfaces 131 on surface 104. As used herein, a "number of" items may be one or more items. For example, number of interfaces 131 may include one or more interfaces. An "interface," such as one of number of interfaces 131, as used herein, may be an interface between any two objects. For example, an interface may be the boundary between two objects that have been joined together. An interface may be the boundary between a fastener element and the object into which the fastener element has been installed.

Fluid 102 may be dispensed from fluid source 116 to applicator 120 using fluid control system 122. Fluid control system 122 may be configured to control the flow of fluid 102 from fluid source 116 to applicator 120. Fluid control system 122 may include at least one of hose 132, valve system 134, nozzle 136, and some other type of fluid transport element or flow control element.

As used herein, the phrase "at least one of," when used with a list of items, may mean that different combinations of one or more of the listed items may be used. In some cases, only one item in the list of items may be needed. For example, "at least one of item A, item B, and item C" may include item A; item A and item B; item A, item B, and item C; item B and item C; or some other type of combination. As another example, "at least one of item A, item B, and item C" may include, but is not limited to, two of item A, one of item B, and ten of item C; four of item B and seven of item C; or some other type of combination. The item may be a particular object, thing, or a category. In other words, at least one of means any combination items and number of items may be used from the list but not all of the items in the list are required.

Hose 132 may be attached to fluid source 116 such that hose 132 is configured to receive fluid 102 dispensed by fluid source 116. The flow of fluid 102 from hose 132 to applicator 120 may be controlled using valve system 134 and/or nozzle 136. Valve system 134 may include, for example, without limitation, at least one of number of valves 138 and number of actuators 140. In one illustrative example, valve system 134 may be used to control amount 142 of fluid 102 sent to applicator 120, while nozzle 136 may be used to control rate 144 at which fluid 102 is sent to applicator 120. In this manner, a controlled amount 142 of fluid 102 may be dispensed, or supplied, to applicator 120 at a controlled rate 144.

As depicted, extension member 117 may be associated with end 146 of platform 114. In particular, extension member 117 may extend from end 146 of platform 114. In this illustrative example, extension member 117 may take the form of arm 118. However, in other illustrative examples, extension member 117 may take some other form.

Extension member 117 allows applicator 120 to be extended away from fluid source 116 such that fluid source 116 and applicator 120 are not co-located together. More specifically, extension member 117 may be configured to maintain a selected distance between fluid source 116 and applicator 120. In this manner, extension member 117 may allow applicator 120 to be positioned within an area in which fluid source 116 does not fit. The area may be, for example, a compartment, a hollow portion of a tube, an interior of a structure, a confined area, or some otherwise difficult-to-reach area. For example, without limitation, extension member 117 may have a size configured such that extension member 117 and applicator 120 may be inserted into an opening in a structure through which fluid source 116 does not fit.

Applicator 120 may be associated with arm 118. Applicator 120 may take the form of any type of device or tool configured for use in applying fluid 102 onto surface 104. As one illustrative example, applicator 120 may take the form of brush 148. Brush 148 may have bristles 150 configured for use in applying fluid 102 onto surface 104.

In one illustrative example, applicator coupling unit 152 may be used to couple applicator 120 to arm 118. Applicator coupling unit 152 may comprise any number of structures, fasteners, and/or other components needed to couple applicator 120 to arm 118. In this illustrative example, applicator coupling unit 152 may couple applicator 120 to arm 118 in a manner that allows applicator 120 to move independently of at least one of applicator coupling unit 152 and arm 118.

Applicator 120 may be moved using applicator movement system 124. Applicator movement system 124 may include at least one of first movement system 154 and second movement system 156. First movement system 154 may be configured to rotate applicator 120 about applicator axis 158. Applicator axis 158 may be a center axis through applicator 120 in one illustrative example. Applicator 120 may be rotated independently of applicator coupling unit 152 and/or arm 118.

As depicted, first movement system 154 may include, for example, without limitation, at least one of number of motors 160, number of shafts 162, number of belt systems 164, and some other type of movement device or element. Belt system 166 may be an example of one of number of belt systems 164. In one illustrative example, belt system 166 may be used to rotate applicator 120 about applicator axis 158.

Belt system 166 may include, for example, without limitation, first pulley 168, second pulley 170, and belt 172. Belt 172 may wrap around both first pulley 168 and second pulley 170. First pulley 168 may be connected to one of number of motors 160 by one of number of shafts 162. Operation of this motor may cause rotation of first pulley 168 in a direction around applicator axis 158, which may, in turn, cause movement of belt 172. Movement of belt 172 may then cause rotation of second pulley 170 in the same direction around applicator axis 158. For example, clockwise rotation of first pulley 168 may result in clockwise rotation of second pulley 170.

Second pulley 170 may be connected to applicator 120 by another one of number of shafts 162 or in some other manner. Rotation of second pulley 170 in a direction around applicator axis 158 may cause rotation of applicator 120 about applicator axis 158. For example, clockwise rotation of second pulley 170 may lead to clockwise rotation of applicator 120 about applicator axis 158. In this manner, first movement system 154 may be configured to move rotate applicator 120 about applicator axis 158. Of course, any configuration of number of motors 160, number of shafts 162, and/or number of belt systems 164 may be used to rotate applicator 120.

Second movement system 156 may also be configured to move applicator 120. In particular, second movement system 156 may be configured to rotate arm 118 about an axis through arm 118, which may be referred to as arm axis 174. Arm axis 174 may be a longitudinal axis through arm 118. In one illustrative example, arm axis 174 may be substantially perpendicular to applicator axis 158. However, in other illustrative examples, applicator 120 may be coupled to arm 118 in such a manner that arm axis 174 is at some other angle relative to applicator axis 158.

When arm 118 rotates about arm axis 174, applicator 120 may be moved along with arm 118. In this manner, the coupling of applicator 120 to arm 118 may be configured such that movement of arm 118 causes the same movement of applicator 120 but movement of applicator 120 may not cause the same movement of arm 118.

Second movement system 156 may include, for example, without limitation, at least one of number of motors 176, number of shafts 178, number of gears 180, number of belt systems 182, and some other type of movement device or element. One or more of number of belt systems 182 may be implemented in a manner similar to the implementation of belt system 166. In some cases, second movement system 156 may be configured to restrict the range of rotation of arm 118 about arm axis 174. In other illustrative examples, second movement system 156 may be configured to allow arm 118 to fully rotate about 360 degrees about arm axis 174.

Of course, depending on the implementation, first movement system 154 and/or second movement system 156 may be implemented in some other manner than described. For example, first movement system 154 and/or second movement system 156 may be implemented using a number of actuators, a number of slip rings, a number of wheels, a number of gears, and/or any number of other types of components. The actuators used may be selected from, for example, without limitation, linear actuators, rotary actuators, shape-memory alloy actuators, electromechanical actuators, hydraulic actuators, pneumatic actuators, and/or other types of actuators.

The illustration of fluid application device 100 in FIG. 1 is not meant to imply physical or architectural limitations to the manner in which an illustrative embodiment may be implemented. Other components in addition to or in place of the ones illustrated may be used. Some components may be optional. Also, the blocks are presented to illustrate some functional components. One or more of these blocks may be combined, divided, or combined and divided into different blocks when implemented in an illustrative embodiment.

Figure 2:
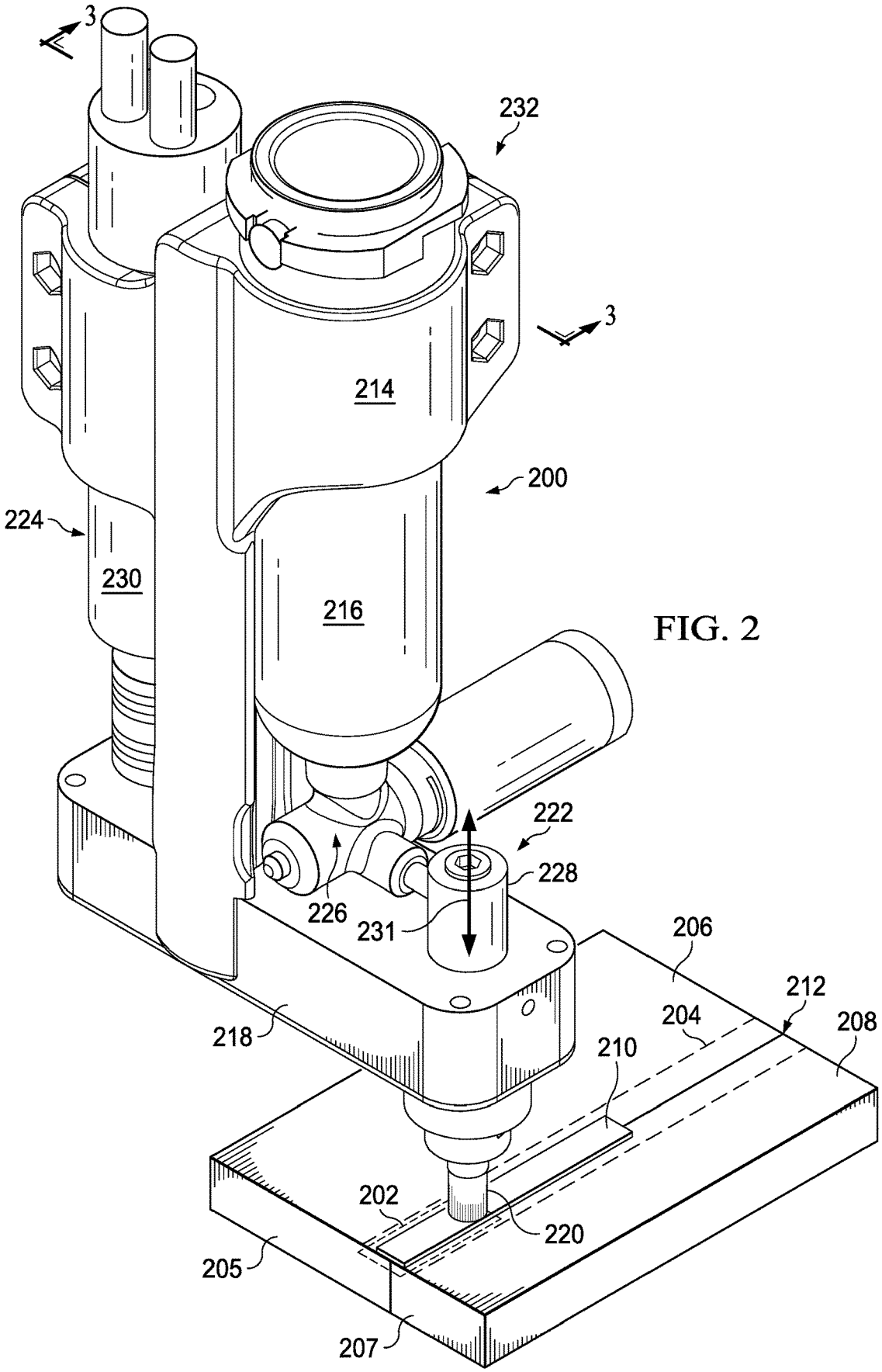
FIG. 2 is an illustration of an isometric view of a fluid application device in accordance with an illustrative embodiment.

With reference now to FIG. 2, an illustration of an isometric view of a fluid application device is depicted in accordance with an illustrative embodiment. In this illustrative example, fluid application device 200 may be an example of one implementation for fluid application device 100 in FIG. 1.

Fluid application device 200 may be used to apply sealant 202 onto surface 204. Sealant 202 may be an example of one implementation for sealant 130 in FIG. 1. Surface 204 may be an example of one implementation for surface 104 in FIG. 1.

As depicted, surface 204 may include a portion of surface 206 of object 205 and a portion of surface 208 of object 207. Object 205 and object 207 have been joined using bracket 210. Fluid application device 200 may apply sealant 202 over surface 204 to seal interface 212 formed between object 205 and object 207 using bracket 210. Interface 212 may be an example of one implementation for one of number of interfaces 131 in FIG. 1.

In this illustrative example, fluid application device 200 may include platform 214, cartridge 216, arm 218, brush 220, fluid control system 222, and applicator movement system 224. Platform 214, cartridge 216, arm 218, brush 220, fluid control system 222, and applicator movement system 224 may be examples of implementations for platform 114, cartridge 126, arm 118, brush 148, fluid control system 122, and applicator movement system 124, respectively, in FIG. 1.

Cartridge 216 may be configured to hold sealant 202 within a chamber (not shown in this view) inside cartridge 216. Cartridge 216 may dispense sealant 202 to brush 220. Brush 220 may be associated with arm 218 in this illustrative example. Further, in this example, arm 218 may be fixedly attached to platform 214. In other words, arm 218 may be unable to move relative to platform 214 in this illustrative example.

Fluid control system 222 may be used to control the amount of sealant 202 dispensed to brush 220 and the rate at which sealant 202 is dispensed to brush 220. In this illustrative example, fluid control system 222 may include valve system 226 and nozzle 228. Valve system 226 and nozzle 228 may be examples of implementations for valve system 134 and nozzle 136, respectively, in FIG. 1.

Applicator movement system 224 may include motor 230 in this illustrative example. Motor 230 may be an example of one implementation for a motor in number of motors 160 in FIG. 1. Operation of motor 230 may cause the activation of a belt system (not shown in this view). Activation of the belt system may cause brush 220 to rotate about applicator axis 231 through brush 220 during the application of sealant 202 onto surface 204. Applicator axis 231 may be an example of one implementation for applicator axis 158 in FIG. 1. When an applicator axis, such as applicator axis 231, is through an applicator in the form of a brush, such as brush 220, the applicator axis may be referred to as a brush axis.

In this manner, applicator movement system 224 may be used to rotate brush 220 about applicator axis 231 as brush 220 is moved along surface 204. Rotating brush 220 during the application of sealant 202 may ensure that sealant 202 is distributed over surface 204 substantially smoothly and evenly.

As depicted, attachment unit 232 may be associated with platform 214. Attachment unit 232 may be an example of one implementation for attachment unit 125 in FIG. 1. Attachment unit 232 may be used to attach platform 214, and thereby fluid application device 200, to a robotic arm (not shown). In other words, attachment unit 232 may allow fluid application device 200 to be used as an end effector for a robotic arm (not shown).

Figure 3:
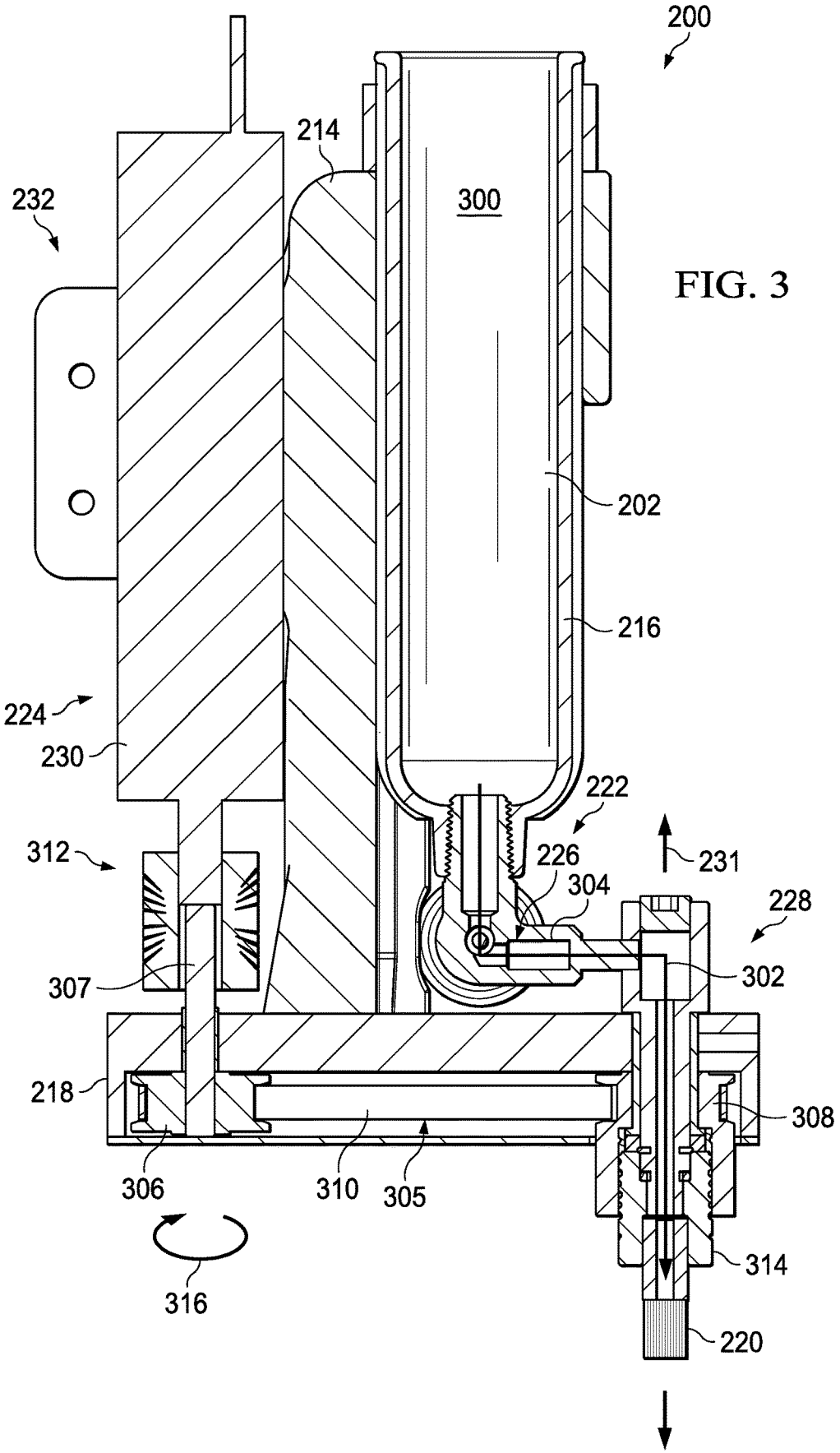
FIG. 3 is an illustration of a cross-sectional view of a fluid application device in accordance with an illustrative embodiment.

With reference now to FIG. 3, an illustration of a cross-sectional view of a fluid application device 200 from FIG. 2 is depicted in accordance with an illustrative embodiment. In this illustrative example, a cross-sectional view of fluid application device 200 from FIG. 2 is depicted, taken along lines 3-3 in FIG. 2.

As depicted, sealant 202 may be held within chamber 300 of cartridge 216. Sealant 202 may be dispensed from cartridge 216 and allowed to flow through fluid control system 222. In this illustrative example, sealant 202 may flow from cartridge 216 to brush 220 along path 302. Valve 304 in valve system 226 of fluid control system 222 may be used to control the amount of sealant 202 dispensed along path 302. Nozzle 228 may be used to control the rate at which sealant 202 flows along path 302 to brush 220.

Additional components of applicator movement system 224 may be seen in this view. In addition to motor 230, applicator movement system 224 may include belt system 305 and shaft 307. Belt system 305 and shaft 307 may be substantially located within platform 214. Belt system 305 may be an example of one implementation for belt system 166 in FIG. 1. Shaft 307 may be an example of one implementation for one of number of shafts 162 in FIG. 1.

Belt system 305 may include first pulley 306, second pulley 308, and belt 310. First pulley 306 and second pulley 308 may be toothed wheels in this illustrative example. Belt 310 may be wrapped around both first pulley 306 and second pulley 308. First pulley 306, second pulley 308, and belt 310, may be examples of implementations for first pulley 168, second pulley 170, and belt 172, respectively, in FIG. 1.

As depicted, first pulley 306 may be connected to motor 230 by shaft 307 and coupling unit 312. Further, second pulley 308 may be connected to brush 220 by applicator coupling unit 314. In this manner, applicator coupling unit 314 may be used Operation of motor 230 may cause rotation of first pulley 306. In one illustrative example, this rotation may be in the direction of arrow 316, a clockwise direction. However, in other examples, the rotation may be in the reverse of the direction of arrow 316, a counter-clockwise direction.

Rotation of first pulley 306 may move belt 310 around first pulley 306 and second pulley 308, which may, in turn, cause rotation of second pulley 308. Rotation of second pulley 308 may cause rotation of brush 220 about applicator axis 231.

Depending on the implementation, a human operator (not shown) or a robotic operator (not shown) may control operation of motor 230, and thereby the rotation of brush 220. Brush 220 may be moved along surface 204 in FIG. 2 to various positions along surface 204 by the human operator or the robotic operator. In this illustrative example, sealant 202 may be dispensed from cartridge 216 to brush 220 in a continuous manner such that sealant 202 may be applied onto surface 204 in FIG. 2 without undesired interruption.

Figure 4:
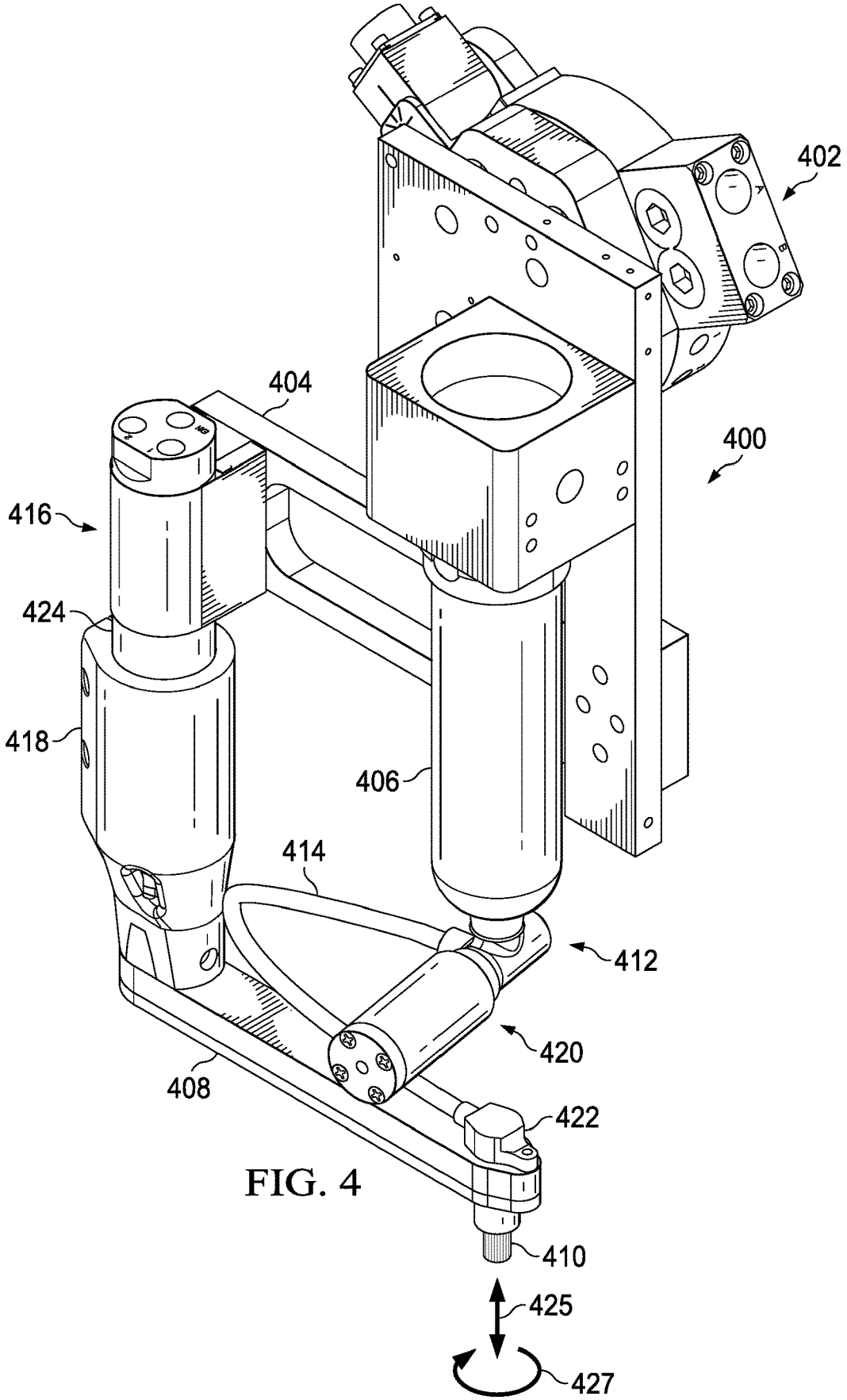
FIG. 4 is an illustration of an isometric view of a different implementation for a fluid application device in accordance with an illustrative embodiment.

With reference now to FIG. 4, an illustration of an isometric view of a different implementation for a fluid application device is depicted in accordance with an illustrative embodiment. In this illustrative example, fluid application device 400 may be an example of one implementation for fluid application device 100 in FIG. 1.

Fluid application device 400 may include attachment unit 402, platform 404, cartridge 406, arm 408, brush 410, fluid control system 412, and applicator movement system 416. Attachment unit 402, platform 404, cartridge 406, arm 408, brush 410, fluid control system 412, and applicator movement system 416, which may be examples of implementations for attachment unit 125, platform 114, cartridge 126, arm 118, brush 148, fluid control system 122, and applicator movement system 124, respectively, in FIG. 1.

In this illustrative example, applicator movement system 416 may be associated with platform 404. Further, structure 418 may be associated with applicator movement system 416. Structure 418 may be used to associate arm 408 with platform 404. Arm 408 may be fixedly associated with platform 404 in this illustrative example. In other words, neither arm 408 nor structure 418 may be moved relative to platform 404 in this example.

As depicted, brush 410 may be associated with arm 408. In this illustrative example, arm 408 may be longer than arm 218 in FIGS. 2-3. In other words, arm 408 may be further extended than arm 218. Consequently, arm 408 may be used to allow brush 410 to be positioned within otherwise difficult to reach locations.

Fluid control system 412 may include valve system 420, nozzle 422, and hose 414. Valve system 420 and nozzle 422 may be examples of implementations for valve system 134 and nozzle 136, respectively, in FIG. 1. Valve system 420 and nozzle 422 may be used to control the amount of sealant (not shown) and the rate of flow of sealant (not shown), respectively, dispensed through hose 414 from cartridge 406 to brush 410.

Applicator movement system 416 may include motor 424. Motor 424 may be operated to rotate brush 410 about applicator axis 425. As one illustrative example, operation of motor 424 may cause rotation of brush 410 about applicator axis 425 in the direction of arrow 427.

With reference now to FIGS. 5-8, illustrations of a fluid application device having different configurations for an applicator movement system are depicted in accordance with an illustrative embodiment. Fluid application device 500 depicted in FIGS. 5-8 may be an example of one implementation for fluid application device 100 in FIG. 1.

Figure 5:
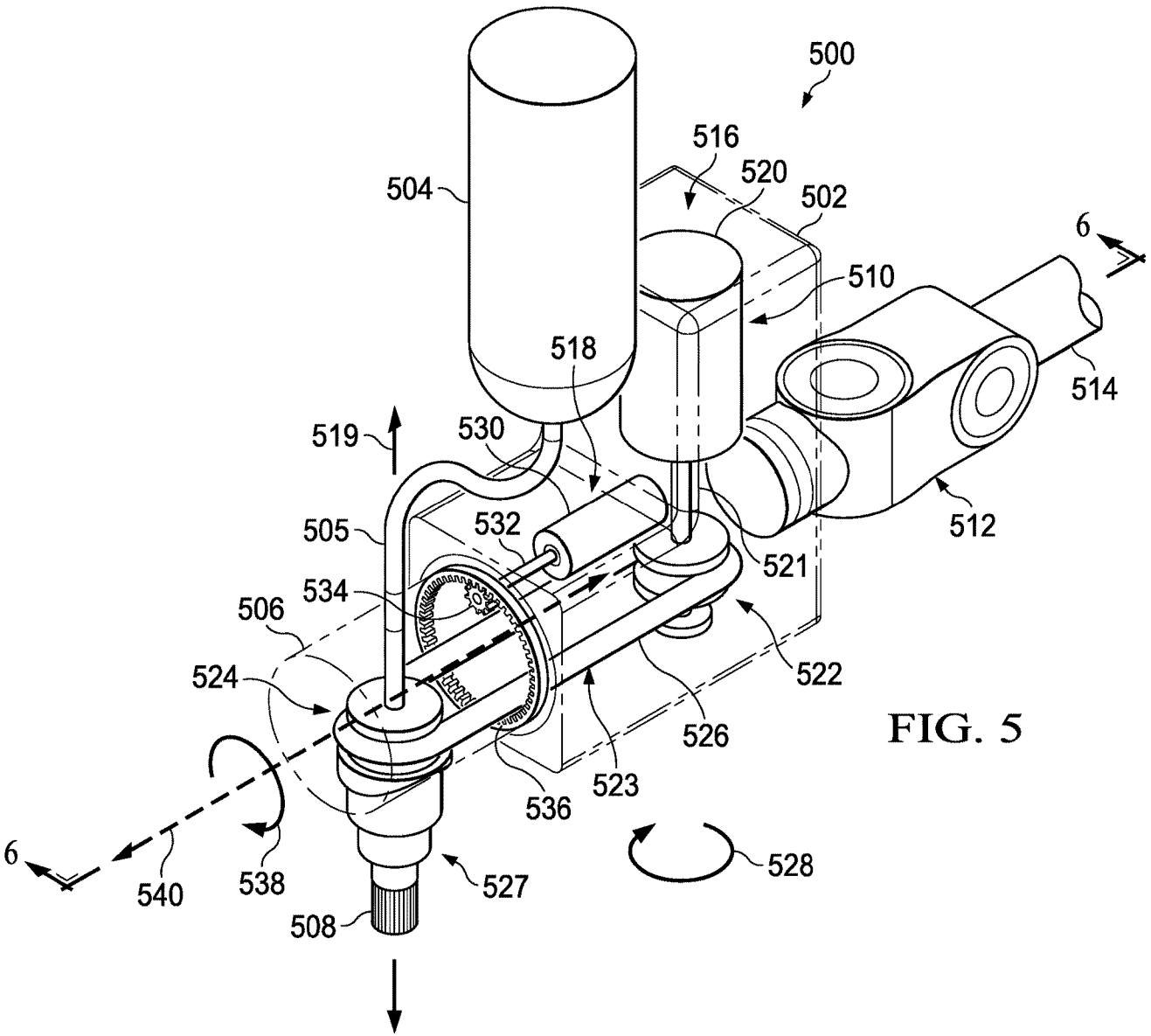
FIG. 5 is an illustration of an isometric view of a fluid application device in accordance with an illustrative embodiment.

Turning now to FIG. 5, an illustration of an isometric view of a fluid application device is depicted in accordance with an illustrative embodiment. As depicted, fluid application device 500 may include platform 502, cartridge 504, hose 505, arm 506, brush 508, applicator movement system 510, and attachment unit 512. Platform 502, cartridge 504, hose 505, arm 506, brush 508, applicator movement system 510, and attachment unit 512 may be examples of implementations for platform 114, cartridge 126, hose 132, arm 118, brush 148, and applicator movement system 124, respectively, in FIG. 1. Attachment unit 512 may be used to attach fluid application device 500 to, for example, without limitation, robotic arm 514.

In this illustrative example, cartridge 504 may be configured to dispense sealant (not shown) to brush 508 through hose 505. Brush 508 may be used to apply the sealant onto a surface (not shown).

Applicator movement system 510 may be configured to move brush 508. As depicted, applicator movement system 510 may include first movement system 516 and second movement system 518. First movement system 516 and second movement system 518 may be an example of one implementation for first movement system 154 and second movement system 156, respectively, in FIG. 1. In this illustrative example, first movement system 516 and second movement system 518 may be entirely housed within platform 502.

First movement system 516 may be configured to rotate brush 508 about applicator axis 519. First movement system 516 may include motor 520, shaft 521, and belt system 523. Belt system 523 may be an example of one implementation for belt system 166 in FIG. 1. Belt system 523 may include first pulley 522, second pulley 524, and belt 526. Second pulley 524 may be associated with applicator coupling unit 527. Applicator coupling unit 527 may be an example of one implementation for applicator coupling unit 152 in FIG. 1. Applicator coupling unit 527 may couple brush 508 to arm 506 in this example.

Operation of motor 520 may cause rotation of first pulley 522, which may, in turn, cause movement of belt 526. Movement of belt 526 may rotate second pulley 524, which may, in turn cause rotation of brush 508 about applicator axis 519. As one illustrative example, brush 508 may be rotated in the direction of arrow 528.

Second movement system 518 may include motor 530, shaft 532, inner gear 534, and outer gear 536. Outer gear 536 may be fixedly attached to arm 506 in this example. Operation of motor 530 may rotate shaft 532, which may cause rotation of inner gear 534. Rotation of inner gear 534 may cause rotation of outer gear 536, which may, in turn, cause rotation of arm 506 about arm axis 540. Arm axis 540 may be an example of one implementation for arm axis 174 in FIG. 1. For example, without limitation, arm 506 may be rotated in the direction of arrow 538 about arm axis 540.

Figure 6:
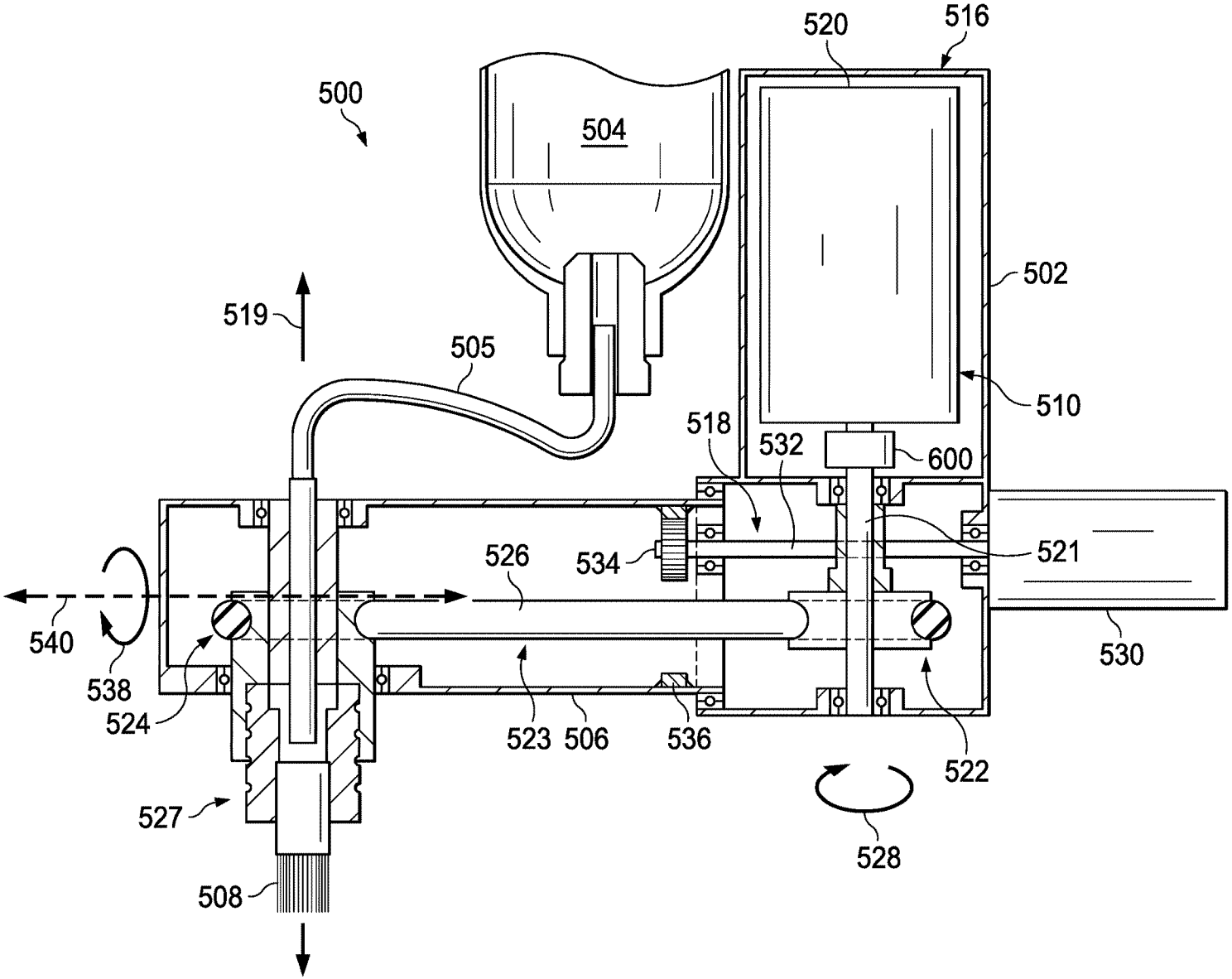
FIG. 6 is an illustration of a cross-sectional view of a fluid application device in accordance with an illustrative embodiment.

Turning now to FIG. 6, an illustration of a cross-sectional view of fluid application device 500 from FIG. 5 is depicted in accordance with an illustrative embodiment. In this illustrative example, a cross-sectional view of fluid application device 500 from FIG. 5 is seen taken along lines 6-6 in FIG. 5.

As depicted, fluid application device 500 may have a different configuration for second movement system 518. In particular, in this example, motor 530 may be located outside of platform 502. Additionally, in this view, coupling unit 600 may be seen. Coupling unit 600 may be configured to couple motor 520 to shaft 521.

Figure 7:
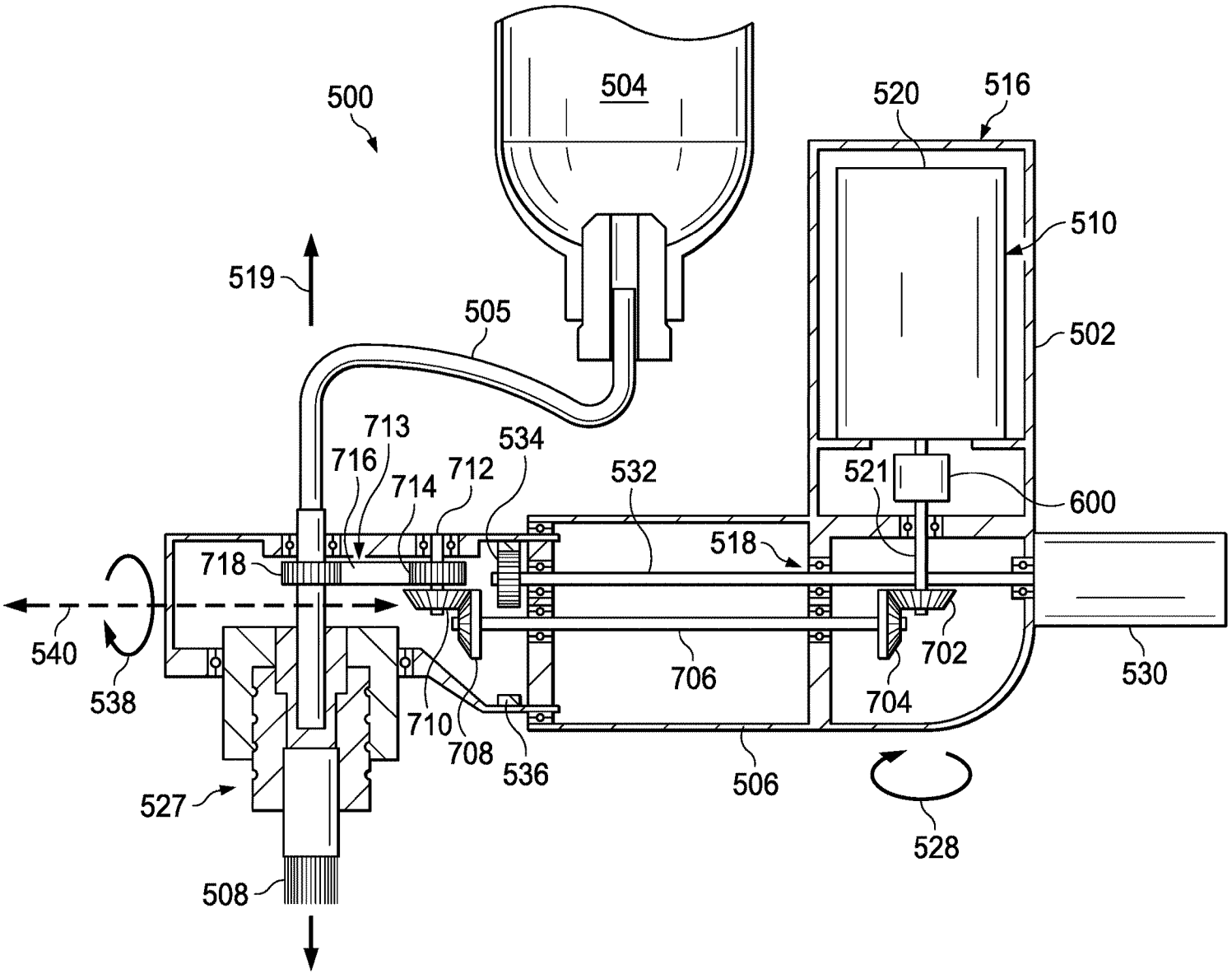
FIG. 7 is another illustration of a cross-sectional view of a fluid application device in accordance with an illustrative embodiment.

With reference now to FIG. 7, another illustration of a cross-sectional view of fluid application device 500 from FIG. 6 is depicted in accordance with an illustrative embodiment. In this illustrative example, fluid application device 500 may have the same configuration for second movement system 518 as depicted in FIG. 5. However, fluid application device 500 may have a different configuration for first movement system 516.

In this illustrative example, first movement system 516 may include motor 520, shaft 521, miter gear 702, miter gear 704, shaft 706, miter gear 708, miter gear 710, shaft 712, and belt system 713. The miter gears may also be referred to as bevel gears in some cases. Belt system 713 may include first pulley 714, belt 716, and second pulley 718.

Operation of motor 520 may cause rotation of shaft 712 and thereby, rotation of miter gear 702. Rotation of miter gear 702 may, in turn, cause rotation of miter gear 704, shaft 706 connected to miter gear 704, and miter gear 708 connected to shaft 706. Rotation of miter gear 708 may cause rotation of miter gear 710 and shaft 712 connected to miter gear 710. Rotation of shaft 712 may cause rotation of first pulley 714, which may lead to the rotation of second pulley 718 by belt 716. Rotation of second pulley 718 may then cause rotation of brush 508 about applicator axis 519.

Figure 8:
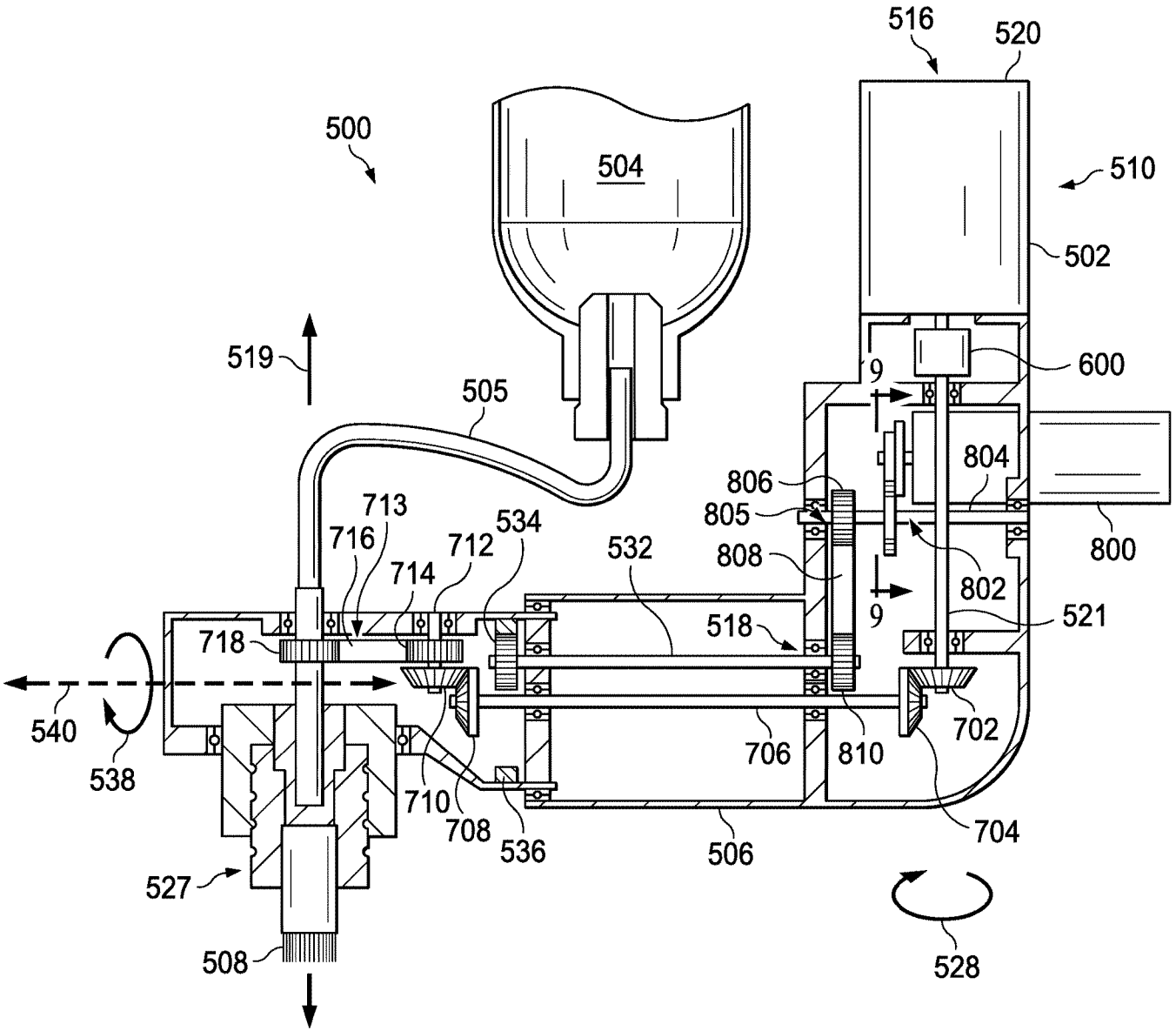
FIG. 8 is yet another illustration of a cross-sectional view of a fluid application device in accordance with an illustrative embodiment.

With reference now to FIG. 8, yet another illustration of a cross-sectional view of fluid application device 500 from FIG. 7 is depicted in accordance with an illustrative embodiment. In this illustrative example, fluid application device 500 may have the same configuration for first movement system 516 as depicted in FIG. 6. However, fluid application device 500 may have a different configuration for second movement system 518.

In this illustrative example, the length of shaft 521 has been extended as compared to the length of shaft 521 in FIGS. 5-7. In FIG. 8, second movement system 518 may include motor 800, turning mechanism 802, shaft 804, belt system 805, shaft 532, inner gear 534, and outer gear 536. Belt system 805 may include first pulley 806, belt 808, and second pulley 810.

Operation of motor 800 may cause activation of turning mechanism 802. Turning mechanism 802 may be used to activate belt system 805. When belt system 805 is activated, first pulley 806 may rotate, thereby causing movement of belt 808 and rotation of second pulley 810. Rotation of second pulley 810 may cause rotation of inner gear 534 by shaft 532, which may, in turn cause rotation of outer gear 536. Rotation of outer gear 536 may cause rotation of arm 506 about arm axis 540.

In this illustrative example, turning mechanism 802 may only activate belt system 805 such that arm 506 may be rotated about arm axis 540 in about 90 degree increments. Turning mechanism 802 may be described in greater detail in FIG. 9.

Figure 9:
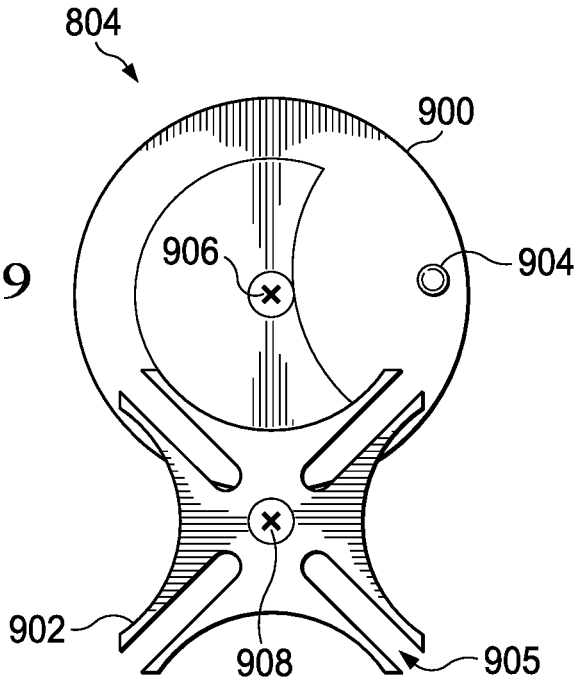
FIG. 9 is an illustration of a view of a turning mechanism in accordance with an illustrative embodiment.

With reference now to FIG. 9, an illustration of a view of turning mechanism 802 from FIG. 8 taken with respect to lines 9-9 is depicted in accordance with an illustrative embodiment. In this illustrative example, turning mechanism 802 may be implemented using a Geneva drive mechanism.

As depicted, turning mechanism 802 may include drive wheel 900, driven wheel 902, and pin 904 attached to drive wheel 900. Driven wheel 902 may have plurality of slots 905. Plurality of slots 905 includes four slots in this example. Each full rotation of pin 904 of about 360 degrees about pivot point 906 may cause rotation of driven wheel 902 by about 90 degrees about pivot point 908. In this manner, driven wheel 902 may only be advanced in about 90 degree increments.

Driven wheel 902 may be connected to shaft 804 in FIG. 8 at pivot point 908. Shaft 804 in FIG. 8 may be connected to first pulley 806 in FIG. 8. Each advance of driven wheel 902 may cause rotation of shaft 804, and thereby rotation of first pulley 806 in FIG. 8. Further, first pulley 806 in FIG. 8 may only be rotated when driven wheel 902 advances. In this manner, the rotation of arm 506 in FIG. 8 may be controlled such that arm 506 remains stabilized when driven wheel 902 is not being advanced.

Figure 10:
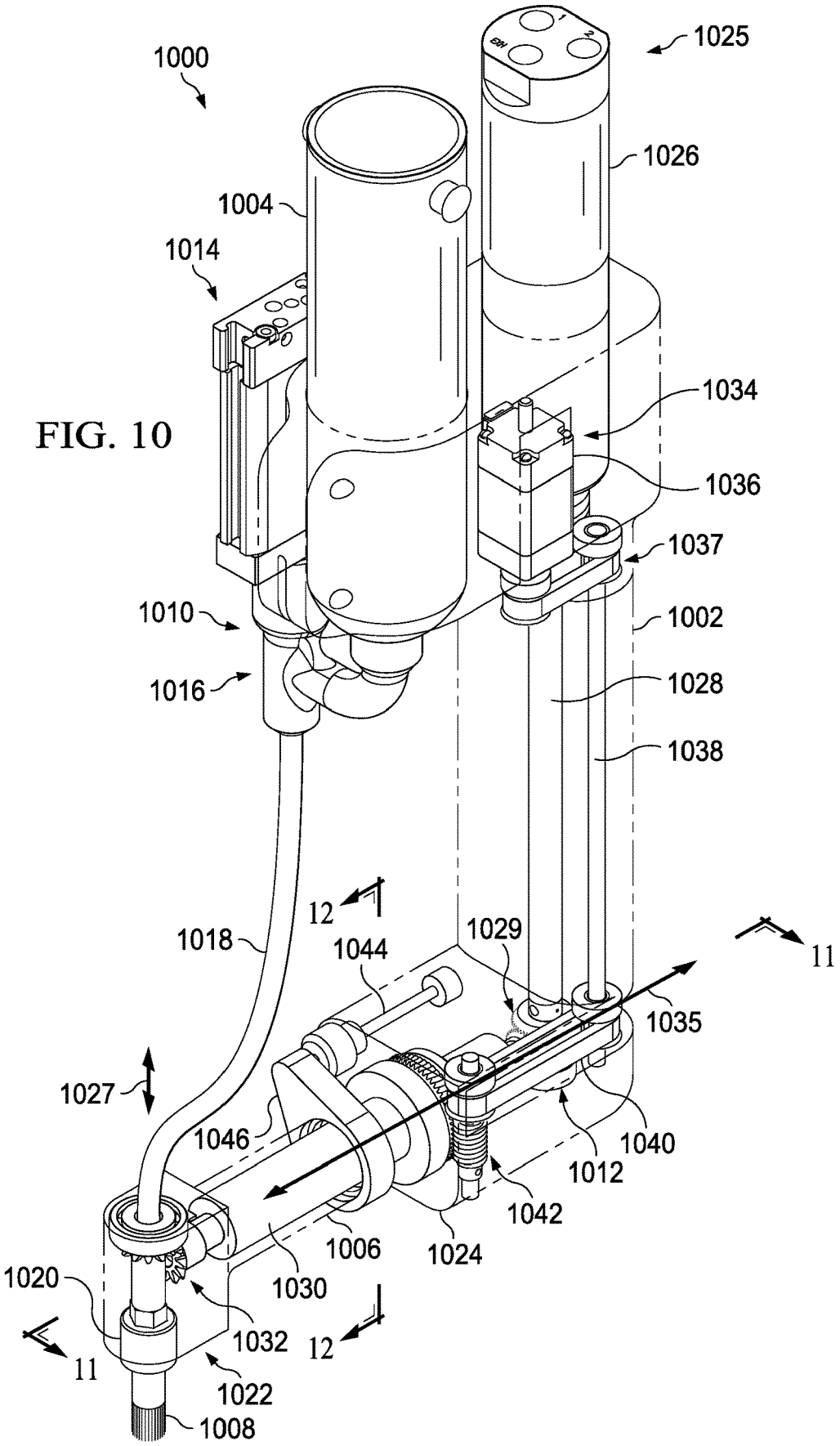
FIG. 10 is an illustration of a fluid application device in accordance with an illustrative embodiment.

With reference now to FIG. 10, an illustration of a fluid application device is depicted in accordance with an illustrative embodiment. In this illustrative example, fluid application device 1000 may be an example of one implementation for fluid application device 100 in FIG. 1.

Fluid application device 1000 may include platform 1002, cartridge 1004, arm 1006, brush 1008, fluid control system 1010, applicator movement system 1012, and attachment unit 1014. Platform 1002, cartridge 1004, arm 1006, brush 1008, fluid control system 1010, applicator movement system 1012, and attachment unit 1014 may be examples of implementations for platform 114, cartridge 126, arm 118, brush 148, fluid control system 122, applicator movement system 124, and attachment unit 125, respectively, in FIG. 1.

In FIG. 10, fluid control system 1010 may include valve system 1016, hose 1018, and nozzle 1020. Fluid control system 1010 may be used to control the dispensing of a sealant held by cartridge 1004 to brush 1008.

In this illustrative example, brush 1008 may be associated with arm 1006 through applicator coupling unit 1022. In this illustrative example, arm 1006 may be attached to end 1024 of platform 1002.

As depicted, applicator movement system 1012 may include first movement system 1025. First movement system 1025 may include motor 1026, shaft 1028, miter gears 1029, telescopic shaft 1030, and miter gears 1032. Operation of motor 1026 may cause rotation of brush 1008 about applicator 1027 through shaft 1028, miter gears 1029, telescopic shaft 1030, and miter gears 1032. When telescopic shaft 1030 is present, arm 1006 may be referred to as a telescopic arm.

Applicator movement system 1012 may also include second movement system 1034. Second movement system 1034 may include motor 1036, belt system 1037, shaft 1038, belt system 1040, and worm drive mechanism 1042. Operation of motor 1036 may cause rotation of arm 1006 about arm axis 1035 in this illustrative example. In particular, operation of motor 1036 may activate belt system 1037, which may, in turn, cause activation of belt system 1040 and worm drive mechanism 1042. Worm drive mechanism 1042 may be configured to cause rotation of a toothed wheel (not shown) fixedly attached to arm 1006.

In this illustrative example, deployment cylinder 1044 may be used to extend and retract arm 1006 with respect to arm axis 1035. Arm 1006 may be connected to deployment cylinder by interface 1046.

Figure 11:
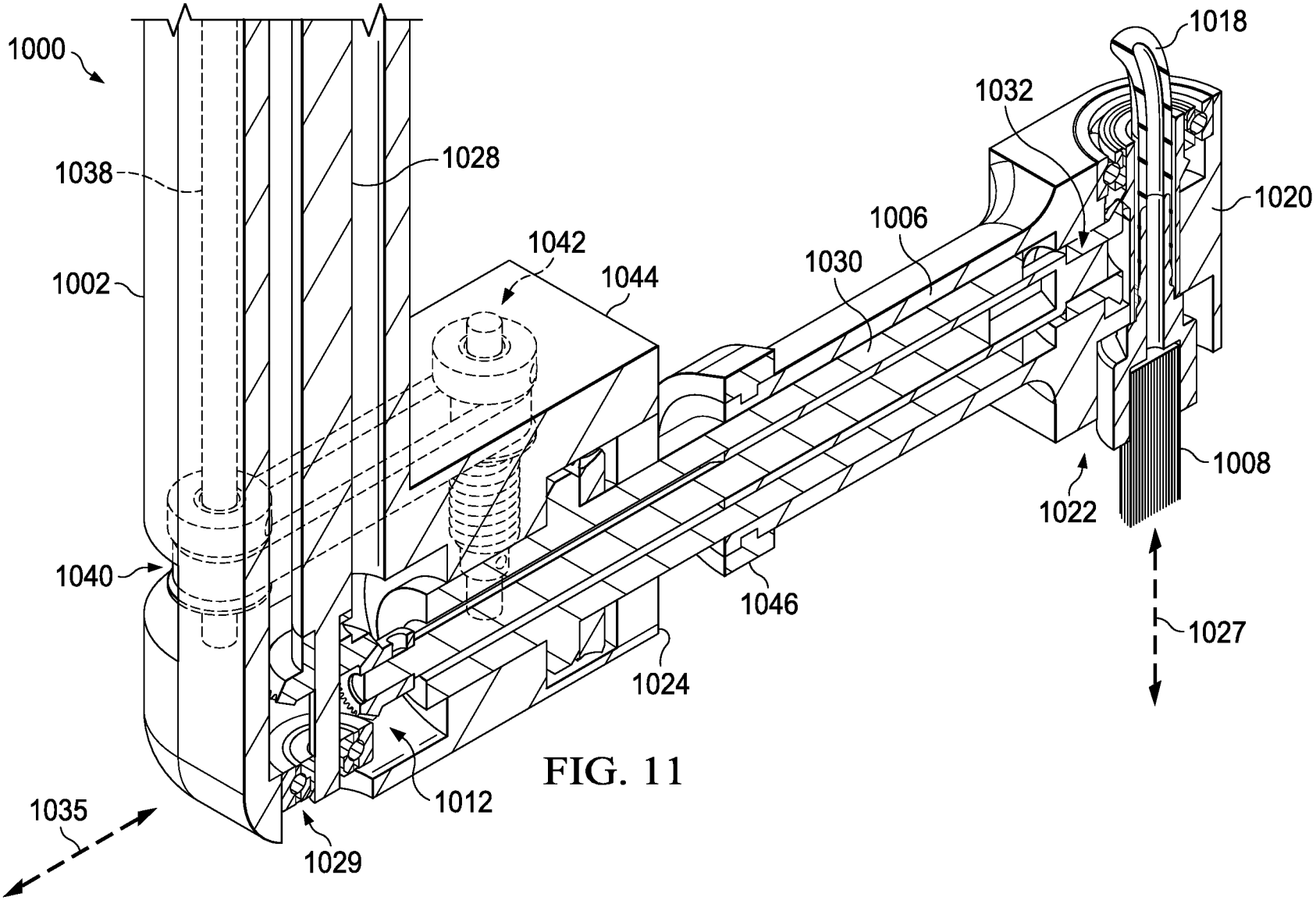
FIG. 11 is an illustration of a cross-sectional view of a fluid application device in accordance with an illustrative embodiment.

With reference now to FIG. 11, an illustration of a cross-sectional view of fluid application device 1000 from FIG. 10 is depicted in accordance with an illustrative embodiment. In this illustrative example, a cross-sectional view of fluid application device 1000 from FIG. 10 is depicted taken along lines 11-11 in FIG. 10. A portion of the various components of applicator movement system 1012 may be more clearly seen in this view.

Figure 12:
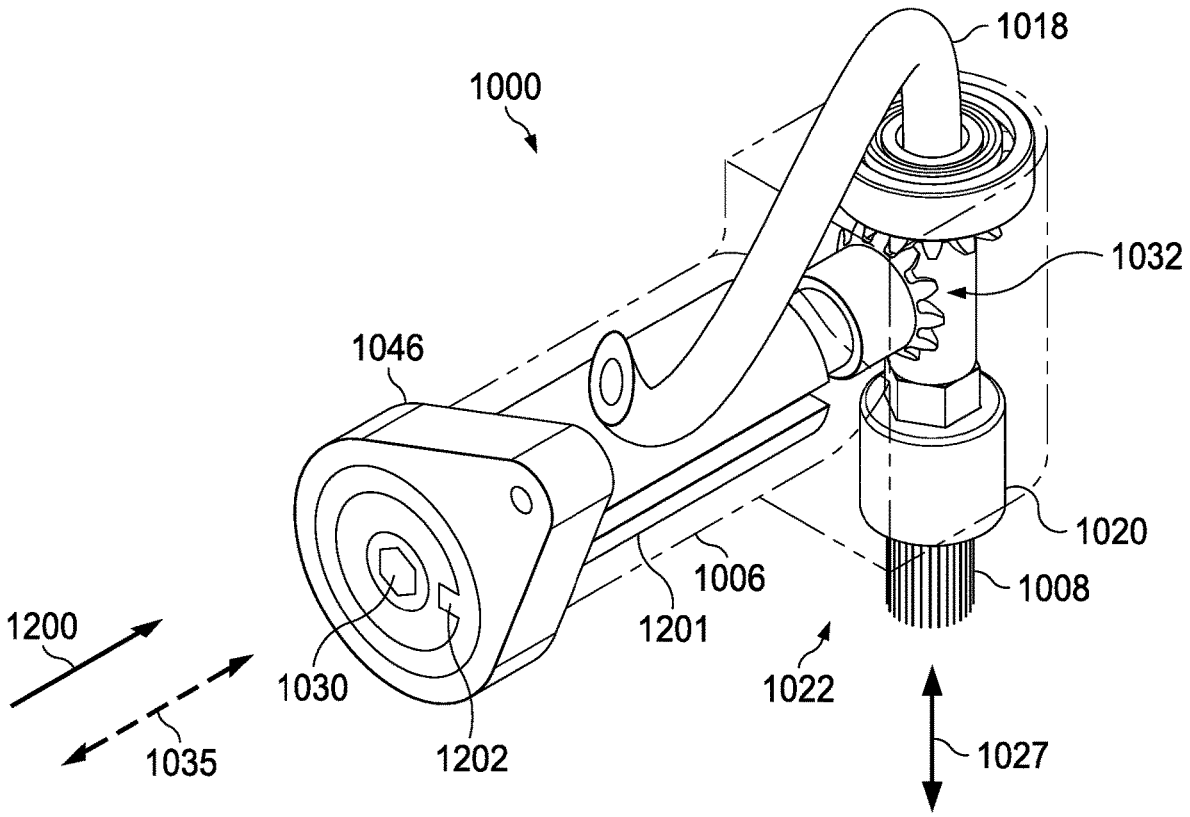
FIG. 12 is an illustration of a view of a fluid application device in accordance with an illustrative embodiment.

Turning now to FIG. 12, an illustration of a view of fluid application device 1000 from FIG. 11 taken with respect to lines 12-12 is depicted in accordance with an illustrative embodiment. In this illustrative example, arm 1006 may be configured to extend and retract with respect to arm axis 1035. For example, without limitation, arm 1006 may be extended, or lengthened, in the direction of arrow 1200 along arm axis 1035. This lengthening may be performed using telescopic element 1201.

Arm 1006 may be configured to move relative to telescopic element 1201 along arm axis 1035. For example, without limitation, arm 1006 may be moved in the direction of arrow 1200 independently of telescopic element 1201. Telescopic element 1201 may be associated with telescopic shaft 1030.

Telescopic shaft 1030 may be associated with miter gears 1029 in FIG. 10 and miter gears 1032. Rotation of miter gears 1029 caused by motor 1026 in FIG. 10 may cause rotation of telescopic shaft 1030. The hexagonal shape of telescopic shaft 1030 may cause telescopic element 1201 to rotate when telescopic shaft 1030 is rotated. Further, interface 1202 between telescopic element 1201 and arm 1006 may ensure that rotation of telescopic element 1201 causes rotation of arm 1006 with telescopic element 1201.

The illustrations of fluid application device 200 in FIGS. 2-3, fluid application device 400 in FIG. 4, fluid application device 500 in FIGS. 5-8, turning mechanism 802 in FIG. 8, fluid application device 1000 in FIGS. 10-12 are not meant to imply physical or architectural limitations to the manner in which an illustrative embodiment may be implemented. Other components in addition to or in place of the ones illustrated may be used.

The different components shown in FIGS. 2-12 may be illustrative examples of how components shown in block form in FIG. 1 may be implemented as physical structures. Additionally, some of the components in FIGS. 2-12 may be combined with components in FIG. 1, used with components in FIG. 1, or a combination of the two.

Figure 13:
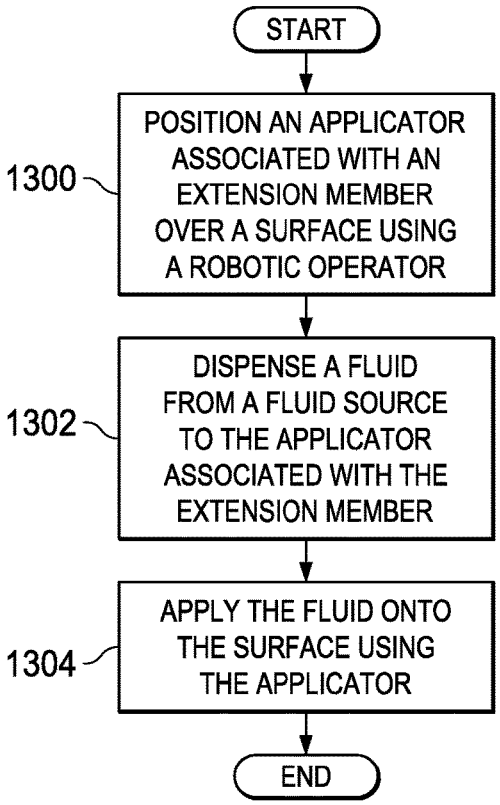
FIG. 13 is an illustration of a process for applying a fluid onto a surface in the form of a flowchart in accordance with an illustrative embodiment.

With reference now to FIG. 13, an illustration of a process for applying a fluid onto a surface is depicted in the form of a flowchart in accordance with an illustrative embodiment. The process illustrated in FIG. 13 may be implemented using, for example, without limitation, fluid application device 100 to apply fluid 102 onto surface 104 in FIG. 1.

The process may begin by positioning applicator 120 associated with extension member 117 over surface 104 using robotic operator 108 (operation 1300). Extension member 117 may be configured to maintain a selected distance between applicator 120 and fluid source 116 for fluid 102. In one illustrative example, operation 1300 may be performed by robotic operator 108 in the form of robotic arm 110.

Next, fluid 102 may be dispensed from fluid source 116 to applicator 120 associated with extension member 117 (operation 1302). Extension member 117 may hold applicator 120 at some selected distance away from platform 114. In this manner, applicator 120 may be positioned within otherwise difficult to reach areas.

Thereafter, fluid 102 may be applied onto surface 104 using applicator 120 (operation 1304), with the process terminating thereafter. In one illustrative example, applicator 120 may take the form of brush 148. Brush 148 may be configured to apply fluid 102 onto surface 104 such that fluid 102 is substantially smoothly and evenly distributed.

Figure 14:
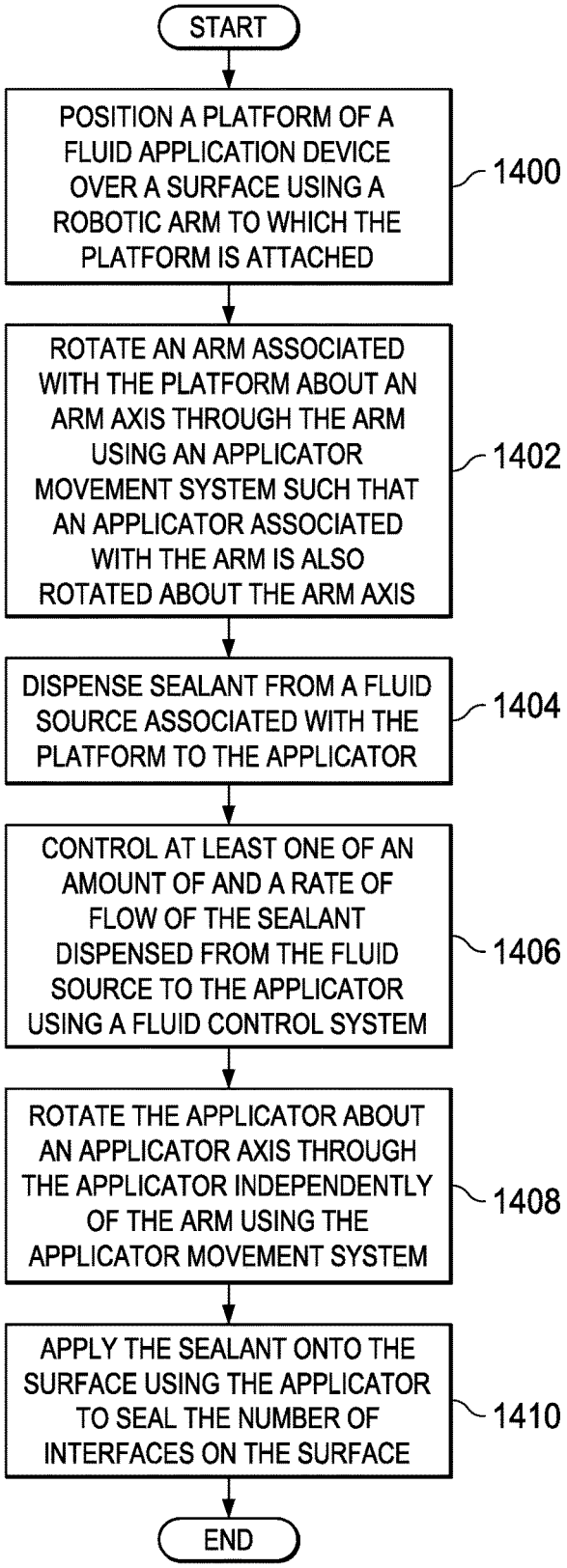
FIG. 14 is an illustration of a process for applying a sealant onto a surface in the form of a flowchart in accordance with an illustrative embodiment.

With reference now to FIG. 14, an illustration of a process for applying a sealant onto a surface is depicted in the form of a flowchart in accordance with an illustrative embodiment. The process illustrated in FIG. 14 may be implemented using, for example, without limitation, fluid application device 100 to apply sealant 130 onto surface 104 in FIG. 1.

Platform 114 of fluid application device 100 may be positioned over surface 104 using robotic arm 110 to which platform 114 is attached (operation 1400). In operation 1400, positioning platform 114 may include positioning arm 118 associated with platform 114. Operation 1400 may be performed in a number of different ways. Robotic arm 110 may be commanded to move platform 114 to move fluid application device 100 using information provided by a positioning system. The positioning system may comprise, for example, without limitation, a vision-based positioning system, a preprogrammed coordinate system, or some other type of positioning system.

The vision-based positioning system may use images generated by cameras to position fluid application device 100. The pre-programmed coordinate system may be configured to provide predefined coordinates to robotic arm 110 for moving platform 114.

Arm 118 associated with platform 114 may be rotated about arm axis 174 through arm 118 using applicator movement system 124 such that applicator 120 associated with arm 118 is also rotated about arm axis 174 (operation 1402).

Sealant 130 may be dispensed from fluid source 116 associated with platform 114 to applicator 120 (operation 1404). At least one of amount 142 of and rate 144 of flow of sealant 130 dispensed from fluid source 116 to applicator 120 may be controlled using fluid control system 122 (operation 1406).

Applicator 120 may be rotated about applicator axis 158 through applicator 120 independently of arm 118 using applicator movement system 124 (operation 1408). Thereafter, sealant 130 may be applied onto surface 104 using applicator 120 to seal number of interfaces 131 on surface 104 (operation 1410), with the process terminating thereafter.

Operation 1408 may be continuously performed during operation 1410 in this illustrative example. In other words, applicator 120 may be continuously rotated while sealant 130 is applied onto surface 104. This type of application of sealant 130 onto surface 104 may improve the consistency with which sealant 130 is applied onto surface 104.

Figure 15:
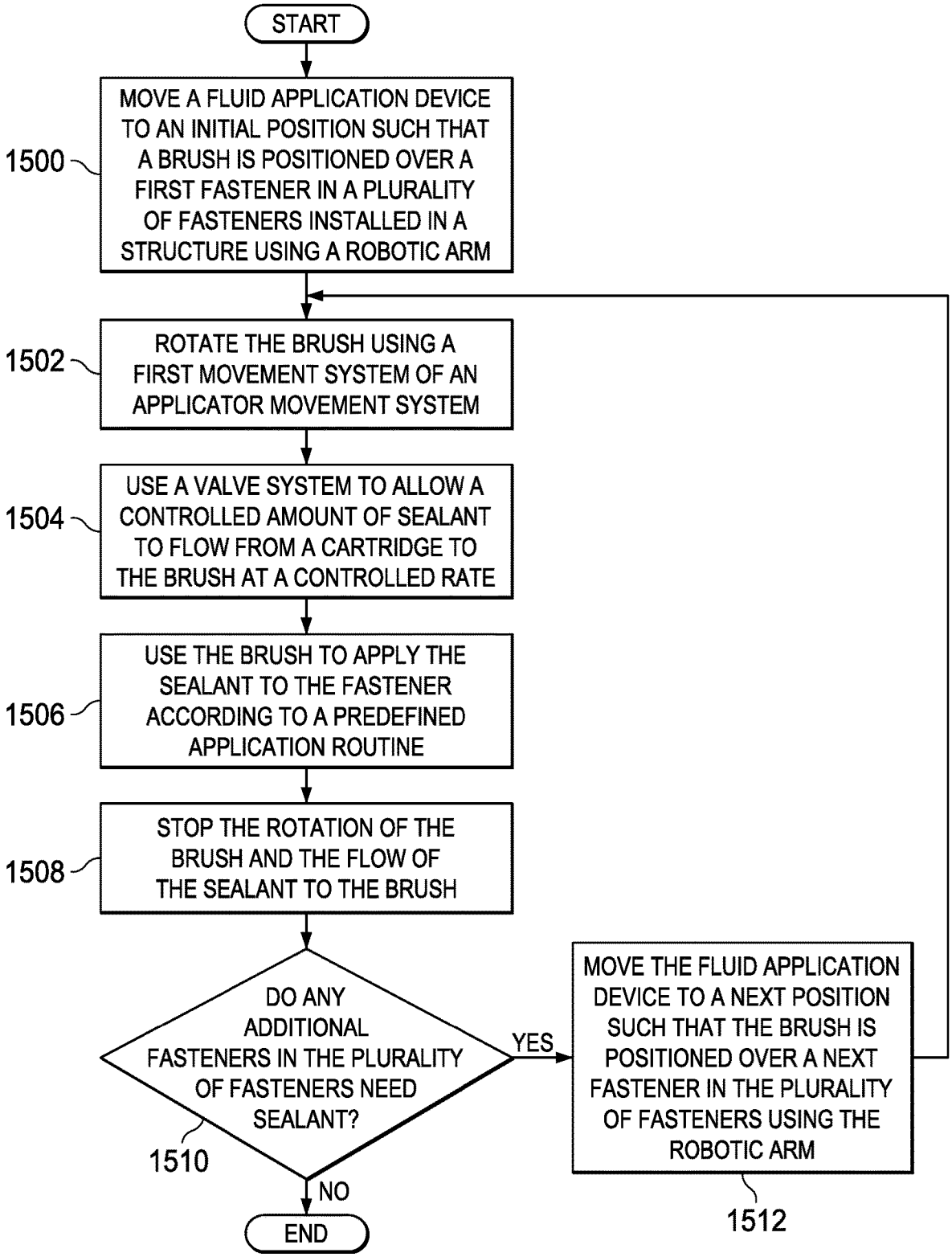
FIG. 15 is an illustration of a process for applying a sealant onto a plurality of fasteners in the form of a flowchart.

With reference now to FIG. 15, an illustration of a process for applying a sealant onto a plurality of fasteners is depicted in the form of a flowchart in accordance with an illustrative embodiment. The process illustrated in FIG. 15 may be implemented using fluid application device 100 in FIG. 1.

The process may begin moving fluid application device 100 to an initial position such that brush 148 is positioned over a first fastener in a plurality of fasteners installed in a structure using robotic arm 110 (operation 1500). Brush 148 is then rotated using first movement system 154 of applicator movement system 124 (operation 1502). Valve system 134 is then used to allow a controlled amount 142 of sealant 130 to flow from cartridge 126 to brush 148 at a controlled rate 144 (operation 1504).

Brush 148 is then used to apply sealant 130 to the fastener according to a predefined application routine (operation 1506). For example, without limitation, robotic arm 110 may be used to control the movement of brush 148 over the fastener by sending commands to second movement system 156 of applicator movement system 124. The predefined application routine for brush 148 may be a particular pattern according to which brush 148 is to be moved to apply sealant 130 over the fastener.

Once sealant 130 has been applied to the fastener, the rotation of brush 148 and the flow of sealant 130 to brush 148 are stopped (operation 1508). A determination is then made as to whether any additional fasteners in the plurality of fasteners need sealant 130 (operation 1510). If no fasteners in the plurality of fasteners still need sealant 130, the process terminates. Otherwise, fluid application device 100 is moved to a next position such that brush 148 is positioned over a next fastener in the plurality of fasteners using robotic arm 110 (operation 1512). The process then returns to operation 1502 as described above.

The flowcharts and block diagrams in the different depicted embodiments illustrate the architecture, functionality, and operation of some possible implementations of apparatuses and methods in an illustrative embodiment. In this regard, each block in the flowcharts or block diagrams may represent a module, a segment, a function, and/or a portion of an operation or step.

In some alternative implementations of an illustrative embodiment, the function or functions noted in the blocks may occur out of the order noted in the figures. For example, in some cases, two blocks shown in succession may be executed substantially concurrently, or the blocks may sometimes be performed in the reverse order, depending upon the functionality involved. Also, other blocks may be added in addition to the illustrated blocks in a flowchart or block diagram.

Figure 16:
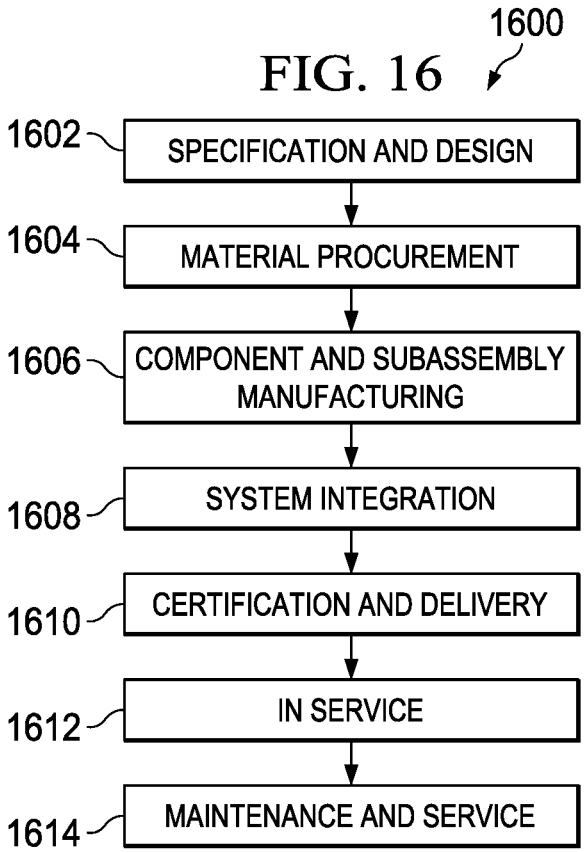
FIG. 16 is an illustration of an aircraft manufacturing and service method in the form of a flowchart in accordance with an illustrative embodiment.
Figure 17:
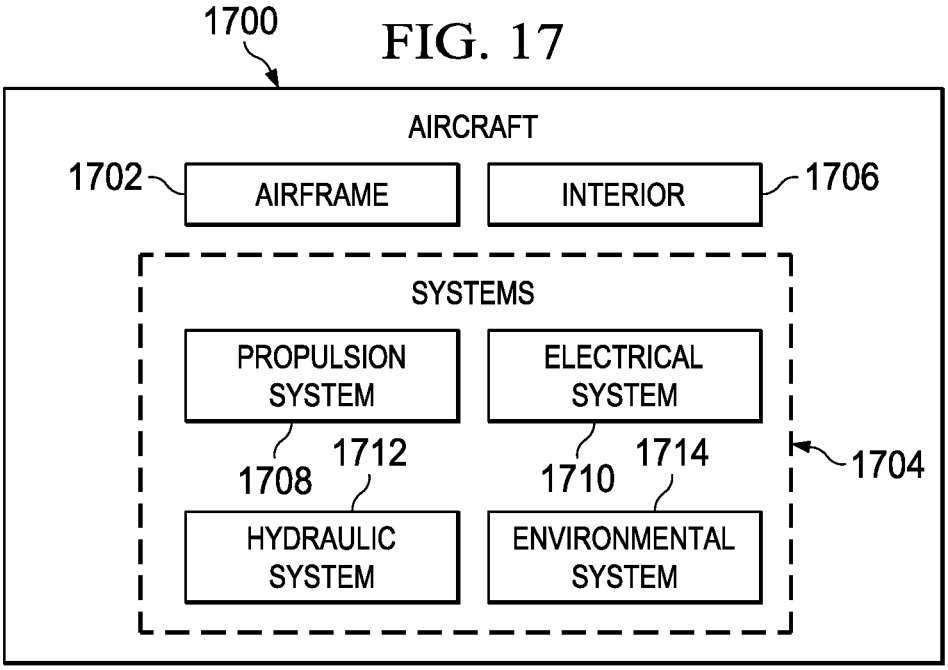
FIG. 17 is an illustration of an aircraft in the form of a block diagram in accordance with an illustrative embodiment.

Illustrative embodiments of the disclosure may be described in the context of aircraft manufacturing and service method 1600 as shown in FIG. 16 and aircraft 1700 as shown in FIG. 17. Turning first to FIG. 16, an illustration of an aircraft manufacturing and service method is depicted in the form of a flowchart in accordance with an illustrative embodiment. During pre-production, aircraft manufacturing and service method 1600 may include specification and design 1602 of aircraft 1700 in FIG. 17 and material procurement 1604.

During production, component and subassembly manufacturing 1606 and system integration 1608 of aircraft 1700 in FIG. 17 takes place. Thereafter, aircraft 1700 in FIG. 17 may go through certification and delivery 1610 in order to be placed in service 1612. While in service 1612 by a customer, aircraft 1700 in FIG. 17 is scheduled for routine maintenance and service 1614, which may include modification, reconfiguration, refurbishment, and other maintenance or service.

Each of the processes of aircraft manufacturing and service method 1600 may be performed or carried out by a system integrator, a third party, and/or an operator. In these examples, the operator may be a customer. For the purposes of this description, a system integrator may include, without limitation, any number of aircraft manufacturers and major-system subcontractors; a third party may include, without limitation, any number of vendors, subcontractors, and suppliers; and an operator may be an airline, a leasing company, a military entity, a service organization, and so on.

With reference now to FIG. 17, an illustration of an aircraft is depicted in the form of a block diagram in which an illustrative embodiment may be implemented. In this example, aircraft 1700 is produced by aircraft manufacturing and service method 1600 in FIG. 16 and may include airframe 1702 with plurality of systems 1704 and interior 1706. Examples of systems 1704 include one or more of propulsion system 1708, electrical system 1710, hydraulic system 1712, and environmental system 1714. Any number of other systems may be included. Although an aerospace example is shown, different illustrative embodiments may be applied to other industries, such as the automotive industry.

Apparatuses and methods embodied herein may be employed during at least one of the stages of aircraft manufacturing and service method 1600 in FIG. 16. For example, without limitation, number of interfaces 131 in FIG. 1 may be located on aircraft 1700. A fluid application device, such as fluid application device 100 from FIG. 1, may be used to apply sealant 130, or some other type of fluid 102, to number of interfaces 131 during component and subassembly manufacturing 1606, system integration 1608, in service 1612, routine maintenance and service 1614, and/or some other stage of aircraft manufacturing and service method 1600 in FIG. 16.

In one illustrative example, components or subassemblies produced in component and subassembly manufacturing 1606 in FIG. 16 may be fabricated or manufactured in a manner similar to components or subassemblies produced while aircraft 1700 is in service 1612 in FIG. 16. As yet another example, one or more apparatus embodiments, method embodiments, or a combination thereof may be utilized during production stages, such as component and subassembly manufacturing 1606 and system integration 1608 in FIG. 16. One or more apparatus embodiments, method embodiments, or a combination thereof may be utilized while aircraft 1700 is in service 1612 and/or during maintenance and service 1614 in FIG. 16. The use of a number of the different illustrative embodiments may substantially expedite the assembly of and/or reduce the cost of aircraft 1700.

Thus, the illustrative embodiments provide a method and apparatus for applying fluid onto a surface. In one illustrative embodiment, an apparatus may comprise a platform, a fluid source associated with the platform, an arm associated with the platform, and an applicator associated with the arm. The fluid source may be configured to dispense a fluid. The arm may be configured to extend from the platform. The applicator may be configured to receive the fluid dispensed by the fluid source. The applicator may be configured for use in applying the fluid onto a surface.

In another illustrative embodiment, a fluid application device may comprise a platform, a cartridge associated with the platform, an arm associated with the platform, a brush associated with the arm, a fluid control system, an applicator movement system, an applicator coupling unit, and an attachment unit. The cartridge may be configured to dispense a fluid. The arm may be configured to extend from the platform. The brush may be configured to receive the fluid dispensed by the cartridge. The brush may be configured for use in applying the fluid onto a surface. The fluid control system may be configured to control at least one of an amount of the fluid and a rate of the fluid dispensed to the brush. The fluid control system may comprise at least one of a hose, a valve system, and a nozzle.

The applicator movement system may be configured to move the brush. The applicator movement system may comprise at least one of a first movement system and a second movement system. The first movement system may be configured to rotate the brush about a brush axis through the brush independently of the arm. The first movement system may comprise at least one of a number of motors, a number of shafts, a number of belt systems, and a number of gears. The second movement system may be configured to rotate the arm about an arm axis through the arm. Rotation of the arm may cause rotation of the brush about the arm axis. The second movement system may comprise at least one of a number of motors, a number of shafts, a number of belt systems, and a number of gears. The applicator coupling unit may be configured to couple the brush to the arm. The attachment unit may be configured for association with the platform. The attachment unit may be configured for use in attaching the fluid application device to a robotic arm as an end effector.

The fluid application device described by the various illustrative embodiments may be used to automate the process of applying fluids, such as sealant, over surfaces. Further, the fluid application device described by the various illustrative embodiments may be used to reduce the time needed to perform these sealant application operations. Still further, the expense of sealant application operations may be reduced by the ability of the fluid application device to control the amount of fluid applied and the rate at which the fluid is applied.

The description of the different illustrative embodiments has been presented for purposes of illustration and description, and is not intended to be exhaustive or limited to the embodiments in the form disclosed. Many modifications and variations will be apparent to those of ordinary skill in the art. Further, different illustrative embodiments may provide different features as compared to other desirable embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. A method for applying a viscous fluid onto a surface, the method comprising:

moving an applicator associated with an extension member along the surface using a robotic operator in which the extension member is configured and a fluid source is located at a first location and the applicator is located at a second location that is different than the first location to maintain a selected distance between the applicator and the fluid source for the viscous fluid, wherein the extension member comprises an arm coupled to the applicator and wherein the applicator rotates around an applicator axis and the arm rotates around an arm axis that is different than the applicator axis;

dispensing the viscous fluid from the fluid source to the applicator at a controlled rate using a fluid control system; and applying the viscous fluid onto the surface using the applicator, wherein the viscous fluid has a viscosity between about 50 poise and about 12,500 poise and wherein moving the applicator comprises moving the applicator in a direction that is different than the applicator axis by rotating the arm around the arm axis while substantially concurrently applying the viscous fluid onto the surface using the applicator wherein the surface is substantially normal to the applicator axis.

2. The method of claim 1, wherein moving the applicator associated with the extension member over the surface using the robotic operator comprises:

moving at least one of the extension member and a platform associated with the extension member using the robotic operator to move the applicator to a position over the surface, wherein the fluid source is associated with the extension member.

3. The method of claim 1 further comprising:

controlling an amount of the viscous fluid dispensed from the fluid source to the applicator using the fluid control system.

4. The method of claim 1 further comprising:

rotating the applicator about the applicator axis through and independently of the extension member using an applicator movement system.

5. The method of claim 1, wherein the arm axis is substantially perpendicular to the applicator axis.

6. The method of claim 1, wherein applying the viscous fluid onto the surface using the applicator comprises:

applying the viscous fluid onto the surface using the applicator to seal a number of interfaces on the surface, wherein the viscous fluid comprises a sealant and the applicator comprises a brush.

7. The method of claim 1 further comprising:

extending the applicator away from a platform using the extension member, wherein the extension member comprises a telescopic arm configured to extend and retract with respect to the arm axis through the telescopic arm.

8. The method of claim 1, wherein moving the applicator associated with the extension member along the surface using the robotic operator comprises:

positioning a platform using a robotic arm to position the extension member over the surface, wherein the platform is attached to the robotic arm by an attachment unit.

9. The method of claim 8, wherein moving the applicator associated with the extension member along the surface using the robotic operator comprises:

moving at least one of the extension member and the platform, wherein the fluid source is associated with the extension member.

10. The method of claim 1, wherein the arm axis is substantially perpendicular to the applicator axis, and wherein applying the viscous fluid onto the surface using the applicator comprises: applying the viscous fluid onto the surface using the applicator to seal a number of interfaces on the surface, wherein the viscous fluid comprises a sealant and the applicator comprises a brush.

11. A method for applying a viscous fluid onto a surface, the method comprising:

moving an applicator associated with an extension member along the surface using a robotic operator in which the extension member is configured and a fluid source is located at a first location and the applicator is located at a second location that is different than the first location to maintain a selected distance between the applicator and the fluid source for the viscous fluid, wherein the extension member comprises an arm coupled to the applicator and wherein the applicator rotates around an applicator axis and the arm rotates around an arm axis that is different than the applicator axis;

rotating the applicator about the applicator axis through and independently of the extension member using an applicator movement system;

dispensing the viscous fluid from the fluid source to the applicator at a controlled rate using a fluid control system;

controlling an amount of the viscous fluid dispensed from the fluid source to the applicator using the fluid control system; and applying the viscous fluid onto the surface using the applicator, wherein the viscous fluid has a viscosity between about 50 poise and about 12,500 poise and wherein moving the applicator comprises moving the applicator in a direction that is different than the applicator axis by rotating the arm around the arm axis while substantially concurrently applying the viscous fluid onto the surface using the applicator wherein the surface is substantially normal to the applicator axis.

12. The method of claim 11, wherein moving the applicator associated with the extension member over the surface using the robotic operator comprises:

moving at least one of the extension member and a platform associated with the extension member using the robotic operator to move the applicator to a position over the surface, wherein the fluid source is associated with the extension member.

13. The method of claim 11, wherein the arm axis is substantially perpendicular to the applicator axis.

14. The method of claim 11, wherein applying the viscous fluid onto the surface using the applicator comprises:

applying the viscous fluid onto the surface using the applicator to seal a number of interfaces on the surface, wherein the viscous fluid comprises a sealant and the applicator comprises a brush.

15. The method of claim 11 further comprising:

extending the applicator away from a platform using the extension member, wherein the extension member comprises a telescopic arm configured to extend and retract with respect to the arm axis through the telescopic arm.

16. The method of claim 11, wherein moving the applicator associated with the extension member along the surface using the robotic operator comprises:

positioning a platform using a robotic arm to position the extension member over the surface, wherein the platform is attached to the robotic arm by an attachment unit.

17. The method of claim 16, wherein moving the applicator associated with the extension member along the surface using the robotic operator comprises:

moving at least one of the extension member and the platform, wherein the fluid source is associated with the extension member.

18. The method of claim 11, wherein the arm axis is substantially perpendicular to the applicator axis, and wherein applying the viscous fluid onto the surface using the applicator comprises: applying the viscous fluid onto the surface using the applicator to seal a number of interfaces on the surface, wherein the viscous fluid comprises a sealant and the applicator comprises a brush.

19. A method for applying a viscous fluid onto a surface, the method comprising:

moving an applicator associated with an extension member along the surface using a robotic operator in which the extension member is configured and a fluid source is located at a first location and the applicator is located at a second location that is different than the first location to maintain a selected distance between the applicator and the fluid source for the viscous fluid, wherein the extension member comprises an arm coupled to the applicator and wherein the applicator rotates around an applicator axis and the arm rotates around an arm axis that is different than the applicator axis;

rotating the applicator about the applicator axis through and independently of the extension member using an applicator movement system;

extending the applicator away from a platform using the extension member, wherein the extension member comprises a telescopic arm configured to extend and retract with respect to the arm axis through the telescopic arm;

dispensing the viscous fluid from the fluid source to the applicator at a controlled rate using a fluid control system;

controlling an amount of the viscous fluid dispensed from the fluid source to the applicator using the fluid control system; and applying the viscous fluid onto the surface using the applicator, wherein the viscous fluid has a viscosity between about 50 poise and about 12,500 poise and wherein moving the applicator comprises moving the applicator in a direction that is different than the applicator axis by rotating the arm around the arm axis while substantially concurrently applying the viscous fluid onto the surface using the applicator wherein the surface is substantially normal to the applicator axis.

20. The method of claim 19, wherein moving the applicator associated with the extension member over the surface using the robotic operator comprises:

moving at least one of the extension member and a platform associated with the extension member using the robotic operator to move the applicator to a position over the surface, wherein the fluid source is associated with the extension member.

21. The method of claim 19, wherein the arm axis is substantially perpendicular to the applicator axis.

22. The method of claim 19, wherein applying the viscous fluid onto the surface using the applicator comprises:

applying the viscous fluid onto the surface using the applicator to seal a number of interfaces on the surface, wherein the viscous fluid comprises a sealant and the applicator comprises a brush.

23. The method of claim 19, wherein the arm axis is substantially perpendicular to the applicator axis, and wherein applying the viscous fluid onto the surface using the applicator comprises: applying the viscous fluid onto the surface using the applicator to seal a number of interfaces on the surface, wherein the viscous fluid comprises a sealant and the applicator comprises a brush.

* * * * *